US007607679B2

(12) United States Patent
Wilson

(10) Patent No.: US 7,607,679 B2
(45) Date of Patent: Oct. 27, 2009

(54) SUSPENSION SYSTEM FOR A SKI

(75) Inventor: Anton F. Wilson, 44 Glengarry Rd., Croton-on-Hudson, NY (US) 10520

(73) Assignee: Anton F. Wilson, Croton-on-Hudson, NY (US)

( * ) Notice: Subject to any disclaimer, the term of this patent is extended or adjusted under 35 U.S.C. 154(b) by 129 days.

(21) Appl. No.: 11/625,753

(22) Filed: Jan. 22, 2007

(65) Prior Publication Data

US 2007/0182129 A1 Aug. 9, 2007

Related U.S. Application Data

(63) Continuation-in-part of application No. 11/283,050, filed on Nov. 21, 2005.

(60) Provisional application No. 60/743,158, filed on Jan. 20, 2006, provisional application No. 60/630,033, filed on Nov. 23, 2004.

(51) Int. Cl.
*A63C 5/07* (2006.01)

(52) U.S. Cl. ..... 280/602; 280/607

(58) Field of Classification Search ..... 280/602, 280/607, 617, 618

See application file for complete search history.

(56) References Cited

U.S. PATENT DOCUMENTS 3,260,531 A 7/1966 Heuvel ..... 280/11.13
3,300,226 A * 1/1967 Reed, Jr. ..... 280/602
4,221,400 A * 9/1980 Powers ..... 280/602
5,393,086 A * 2/1995 Le Masson et al. ..... 280/602
5,597,170 A 1/1997 Le Masson et al. ..... 280/602
5,671,939 A * 9/1997 Pineau ..... 280/602
5,704,628 A * 1/1998 Boehm et al. ..... 280/602
5,924,717 A * 7/1999 Janisch et al. ..... 280/602
7,134,680 B2 * 11/2006 Emig et al. ..... 280/602

OTHER PUBLICATIONS

Communication from a foreign patent office in a counterpart application (Int'l. Search Report from Int'l App. No. PCT/US05/42129), dated May 21, 2007.

* cited by examiner

*Primary Examiner*—Frank B Vanaman
(74) *Attorney, Agent, or Firm*—Fish & Richardson P.C.

(57) ABSTRACT

Suspension systems are provided for skis. In some implementations, the suspension system includes a spring-like element and a support structure configured to attach one end of the spring-like element to the central half of the longitudinal running length of a ski body. The spring-like element is configured so that the opposite end of the spring-like element contacts the ski body at a contact point on the front-most or rear-most fifth of the longitudinal running length of the ski body, and applies a downward force at the contact point such that the degree of free camber of the ski is increased relative to the natural free camber of the ski body without the suspension system attached.

22 Claims, 20 Drawing Sheets

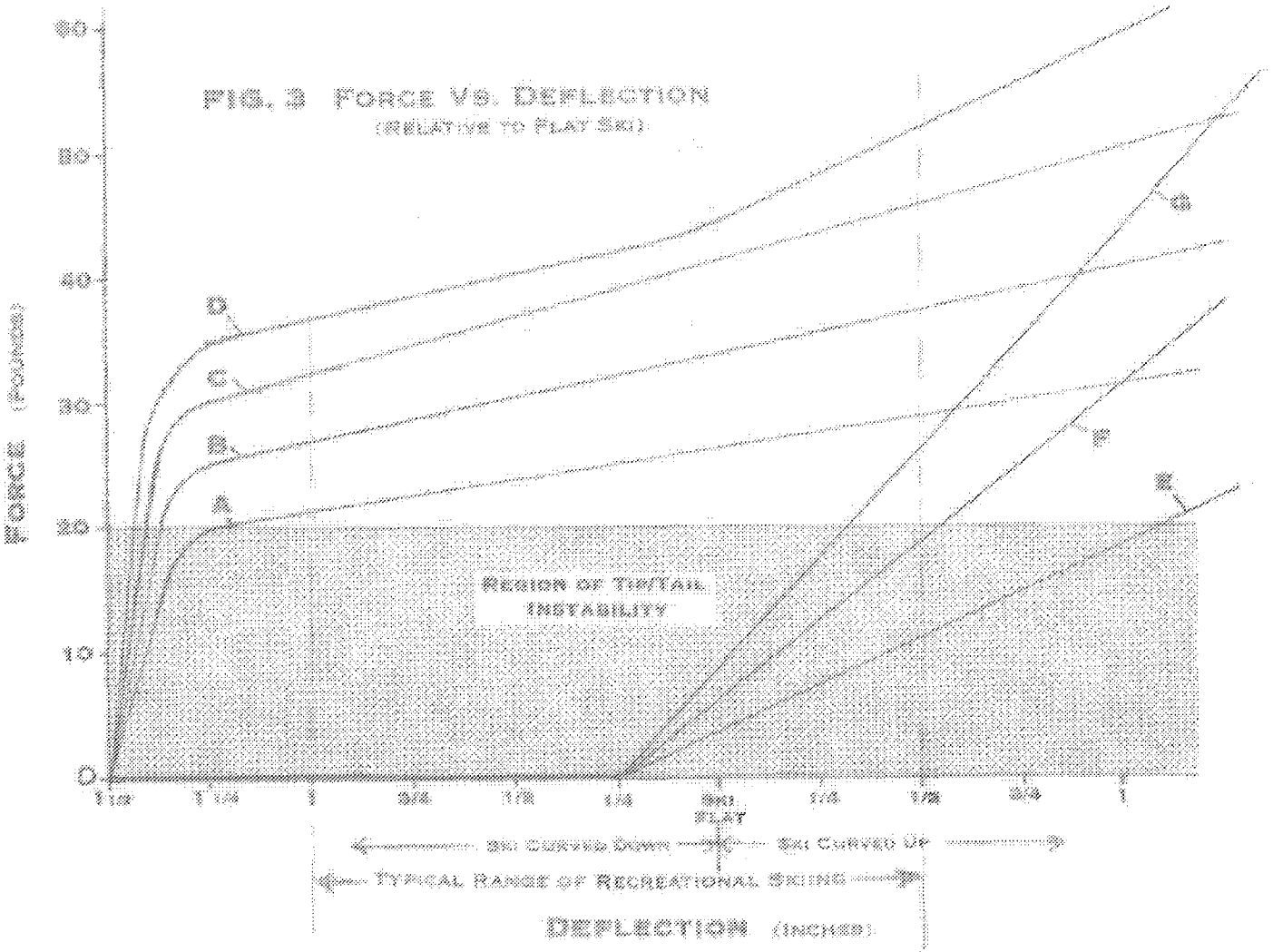
FIG. 3 FORCE VS. DEFLECTION
(RELATIVE TO PLAY SIZE)
REGION OF TOTAL INSTABILITY
TYPICAL RANGE OF RECREATIONAL SKIING
DEFLECTION (INCHES)
FORCE (POUNDS)
A
B
C
D
E
F
0
10
20
30
40
50
60

SUSPENSION SYSTEM FOR A SKI

CROSS-REFERENCE TO RELATED APPLICATIONS

This application claims benefit from U.S. Provisional Patent Application No. 60/743,158, filed Jan. 20, 2006, and is a continuation-in-part of U.S. Ser. No. 11/283,050, filed Nov. 21, 2005, now pending, which claimed benefit from U.S. Provisional Patent Application No. 60/630,033, filed Nov. 23, 2004. The entire contents of these applications are incorporated by reference herein.

TECHNICAL FIELD

This disclosure relates to skis and methods of skiing, and more particularly to skis for use at downhill ski areas.

BACKGROUND

Recreational alpine skiing, as it is taught and practiced around the world on groomed slopes, is a technique of controlled skidding. The modern ski is designed to skid on the snow in a manner that creates frictional forces that the skier uses to control both speed and direction. Often, a beginning skier is taught how to turn by manipulating pressure on the front and back of the ski unequally in order to create unequal skidding forces. It is the difference between front and back skidding forces that creates the turning moment. Virtually all recreational skiers make use of this basic technique.

The advent of 'shaped' or 'parabolic' skis has provided the alpine skier with an additional technique for turning: carving. Mastering the carved turn using these types of skis involves angulating the ski firmly onto one edge or the other—a technique that most beginning skiers find extremely difficult. The edge should lock into the snow and a specific arc or turn will occur automatically. The incredible control and efficiency of the 'carved turn' has made this technique highly desirable.

Unfortunately, pure carve skiing is difficult to attain as a practical matter. In his classic book "Skiing Mechanics" and again in the 2001 edition "The New Skiing Mechanics," John Howe states "There is only one true continuous, balanced, carved turn radius for a given side cut radius and velocity." John Howe, *the New Skiing Mechanics*, p. 130 (McIntire Publishing 2d ed. 2001). In other words, the turning radius of a ski is 'built into' the ski through design and construction. Under specific conditions, the skier can only carve one turn radius. The skier is forced to change the conditions (e.g., change his or her speed) or break out of the carve and into a skid if a shorter or longer turn is desired.

This difficulty is exacerbated by the fact that the tip and tail of conventional skis are virtually unloaded before the ski is bent into a turn. It is not until the tip and tail edges have grabbed the show and bent into an arc that the tip and tail of the ski apply significant pressure. Paradoxically, without this pressure, it is difficult to engage the edge to get the ski to bend in the first place. In order to initiate a subtle, long radius turn, the carving skier should be able to slightly roll the ski into a very gentle edge angle. In reality, current ski designs generally cannot respond to such subtle input because the tip and tail are unable to grab the snow effectively until they are bent into a more severe arc. These limitations generally confine the skier to a narrow range of turn radii, making continuous carve skiing problematic.

An alpine ski generally must have a running surface with edges to slide over and/or engage the snow, and sufficient longitudinal spring force to allow the ski to bend into an arc when angled, and then straighten out when placed flat. Historically, these two functions have been performed by a single component: a runner that acts as a long leaf spring and that has a polyethylene base to slide on the snow and steel edges to engage hardpack and ice. An alpine ski is thus basically a continuous leaf spring with a boot attached near the middle and the force and aft extremities (tip and tail) cantilevered over the snow.

A conventional alpine ski has no preload forces on the tip and tail of the ski. (While the slight camber or arc designed into all conventional skis does create a very slight pressure at the tip and tail on a flat surface, it is negligible for purposes of steering the ski at shallow edge angles and is easily nullified by typical uneven terrain). Thus, with the ski flat on a groomed snow surface, virtually all the weight of the skier is being applied to the snow directly under the skier's boot, with almost no pressure applied to the snow at the tip and tail of the ski. Unfortunately, it is the tip and tail of the ski that create stability and the most significant turning forces. This is a main reason why a conventional shaped ski tends to be unstable until it is edged to a significant angle, i.e., the characteristic turning arc of that ski. Additionally, the small area of high pressure under the boot causes the flat ski to go slower by penetrating the snow surface to a greater extent, which is undesirable for a ski racer.

Because conventional skis lack any significant preload in the straight or unbent condition, such skis are generally designed and constructed to function as a very high spring rate (very stiff) leaf spring. This high spring rate allows the tip and tail to build up significant pressure rapidly as the ski beings to bend, thus providing the required stability along the entire length of the ski at the characteristic turning radius. Unfortunately the high spring rate can also preclude any great variety of turning radii. Once the skier has used his weight to bend the ski into an arc against the high spring rate, the additional bending necessary to create a significantly tighter turning radius may not be possible for lighter skiers.

The high spring rate also tends to make the ski stiff and unforgiving over terrain that is not perfectly smooth, which can throw a recreational skier off balance.

Worse yet, when a conventional ski encounters a typical convex surface, almost the entire length of the ski can lose contact with the snow surface (FIG. 20A), potentially causing the skier to lose all control.

SUMMARY

The invention features ski suspension systems with skis that in combination have dynamic characteristics that are dramatically different from those of the conventional "shaped" skis described above. Generally, the skis with suspension systems described herein have a very wide range of turning radii with a negligible zone of instability. As a result, the skier or glider can increase or decrease the turning radius at will and effortlessly make a smooth transition from a right turn to a left turn. In some implementations, this is accomplished by providing the skis with a significant preload force and a relatively low spring rate. With the ski flat on the snow, the preload already applies a significant portion of the weight of the skier to the tip and tail of the ski. As a result, as the skier eases into a subtle edge angle, the tip and tail can immediately engage the snow with stability. The skies do not have to be bent up to a threshold arc to turn, and thus the skier can generally steer from wide left turns to wide right turns smoothly with ease. The preload forces also provide significantly greater fore and aft stability for the recreational skier. The biggest problem for a beginner and intermediate skier is generally balance and stability. A recreational skier typically leans backwards when imbalanced or frightened, which lifts the tip of the ski off the snow causing the inevitable fall. It is this constant falling and loss of control that is the most frequent reason given by those who have given up the sport. The suspension system herein precludes this constant falling and loss of control by creating a long travel, independently pressured tip and tail such that the tip and tail will be kept constantly pressured and curved onto the snow even when the skier becomes significantly imbalanced and leans backwards. Additionally, this preload makes a racing ski faster when the ski is held with its base flat against the snow by spreading the racer's weight over a larger area, thus reducing penetration into the snow surface.

The relatively low spring rate of the ski works together with the preload to create a broad, responsive range of turn radii. As the skier edges (or banks) into a tighter turn, the additional pressure created by centrifugal force is no longer insignificant, since it is not overcome by the spring rate of the ski. Thus, the pressure generated by centrifugal force can be used to bend the ski into a more severe arc and thus a tighter turn.

The low spring rate also makes the ski more supple and less reactive to surface irregularities. This creates a smoother ride, absorbing forces that would normally be disconcerting to the recreational skier.

In one aspect, the invention features a suspension system designed to be connected to a ski or glider body so as to apply a vertical downward force to the first and second ends of the ski body. The suspension system may apply the force before and/or during flexure of the ski.

The suspension system may be configured so that the downward force of the skier's weight is applied to three or more distinct points along the length of the ski body. For example, at least one of the points of applied downward force may be located directly under a boot mounting position, at least one other point may be generally located between the boot mounting position and the tip of the ski body, and at least one other point may be generally located between the boot mounting position and the tail of the ski body. The suspension system may be configured so that at least one of the points of applied downward force is located in a front longitudinal fifth of the ski body, at least one other point is located in a center longitudinal third of the ski body, and at least one other point is located in a rear longitudinal fifth of the ski body. The suspension system may be alternately configured so that at least one of the points of applied downward force is located in a front longitudinal eighth of the ski body, at least one other point is located in a center longitudinal third of the ski body, and at least one other point is located in a rear longitudinal eighth of the ski body.

In some cases, the suspension system can be configured to provide the ski with a spring rate that diminishes as the ski is flexed from a normal unloaded state or a predetermined state of deflection (as defined below with reference to FIG. 3A) to a state of greater deflection.

For example, the suspension system may be configured so that at a predetermined degree of deflection the spring rate exhibited by the ski will be at least 10% less than a maximum spring rate exhibited by the ski at lesser degrees of deflection.

As another example, the suspension system may be configured so that at a predetermined degree of deflection the spring rate exhibited by the ski will be 90% less than a maximum spring rate exhibited by the ski at lesser degrees of deflection. In some cases the suspension system can be configured to provide the ski with a spring rate that increases after the ski is flexed beyond a predetermined state of deflection to a state of greater deflection. In addition the said predetermined state of deflection can be adjustable independently for the front and rear halves of the ski respectively.

In some cases the suspension system can be configured to provide the ski with a spring rate that diminishes as the ski is flexed from a normal unloaded state or a predetermined state of deflection to a state of greater deflection, and a predetermined further state of deflection, provide the ski with a spring rate that increases after the ski is flexed beyond said predetermined state of deflection to a state of greater deflection.

In some cases the suspension system can be configured to provide the ski with a three-stage spring rate, for example a first initial extremely high spring rate when deflected from the unloaded state, followed by a second low spring rate for further deflection, followed by third spring rate intermediate the first and second spring rates for yet further deflection.

In some implementations, the suspension system is connected to the ski body by a mounting/linkage system, the mounting/linkage system being configured so that when the ski body is flexed beyond a predetermined degree of deflection the load applied to the ski body by the suspension system decreases or exhibits a decreasing spring rate.

The suspension system may include a spring, e.g., a pneumatic spring or pneumatic shock. The spring may be selected from the group consisting of coil springs, torsion springs, torsion bars, leaf springs, and elastomers. The spring may include damping elements and exhibit damping characteristics that are imparted to the attached ski.

The suspension system may include a linkage between the first end of the ski body and the second end of the ski body that enables positive deflection of the first end of the ski body to increase the spring force at the second end of the ski body and positive deflection of the second end of the ski body to increase the spring force at the first end of the ski body.

The suspension system may also include a support structure that is attached to a longitudinally central area of the ski, and a mounting system that attaches the support structure to the ski in a manner that substantially precludes yaw and roll movement between the support structure and the ski body. The mounting system may include elements configured to allow elastic movement between the support structure and the ski body in the vertical and longitudinal directions as well as around the pitch axis. The support structure may carry a boot binding. If the suspension structure includes a spring, the spring may be located directly below the boot binding and connected to the first and second ends of the ski body by a linkage system. The support structure may be releasably attached to the ski body. The suspension system may include a spring-like compressible element, e.g., a leaf spring, attached between the support structure and a front and/or rear longitudinal third of the ski body. The suspension system may include one or more tensionally sprung elements attached to the support structure that contact a front and/or rear longitudinal third of the ski body, creating downward forces in those respective areas.

The suspension system may be configured to have any one or more of the following characteristics. To cause the ski body to deflect 0.25 inch, it is necessary to apply a force of 15 pounds or greater. The force required for a 1.0 inch deflection is less than three times the force required for a 0.25 inch deflection. The spring rate exhibited during the first 0.25 inch of deflection of the ski body is at least 110% of the spring rate exhibited during the next 0.25 inch of deflection. The additional force that must be applied to deflect the ski body from 0.25 inches deflection to 0.50 inches deflection is at least 10% less than the force that must be applied to deflect the ski body from 0.0 inches deflection to 0.25 inches deflection. The force required for a 0.40-inch deflection is at least 10% greater than the additional force required for a 0.80 inch deflection. The force required to deflect the ski body to a horizontally collinear state is within the range of 15 to 100 pounds.

The suspension system may be configured to allow a minimal initial deflection before a predetermined state of deflection at which point further significant deflection is precluded until the force applied by the skier exceeds a predetermined amount. In this case, the ski may include an adjustment mechanism configured to allow the predetermined degree of deflection at which the suspension applies a downward force to the first and second ends of the ski body to be adjustable. The adjustment mechanism may be configured to allow the downward force applied to the ski to be turned on and off. The suspension system may also be configured so that the downward force is not applied to the ski body by the suspension system until the ski body is flexed to a predetermined degree of deflection.

In another aspect, the invention features a suspension system configured to restrain or diminish the natural free camber of the ski body to which it is attached in order to create an immediate preload. Such a suspension system may comprise one or more support structures that are attached to a longitudinally central area of the ski. Such attachment could comprise a mounting system that substantially precludes yaw and roll movement between the support structure and the ski body. The mounting system may include elements that enable elastic movement between the support structure and the ski body in the vertical and longitudinal directions as well as around the pitch axis. Such a suspension system may also comprise at least two tension elements, each connected to the central half of the ski body by said support structure(s) and also connected to the front and rear third of said ski body respectively. The support structure may carry a boot binding. The suspension system may further include an adjustment device to allow the degree to which the camber is restrained to be adjusted. Preferably this suspension system would be attached to a ski specially constructed with a very high degree of camber and a lower than normal spring rage, as an example, 2" to 5" of natural camber with a spring rate of 10 to 15 lb per inch.

In another aspect, the invention features a suspension system that can be connected to a ski body so as to apply a load to the front and back of the ski body, the suspension system being configured to contribute at least 20% and up to 100% of the resistive force that must be overcome in order to deflect the ski body from zero deflection to 0.25 inch deflection, the remaining resistive force that must be overcome, if any, being contributed by the ski body.

In another aspect, the invention features a suspension system that can be connected to a ski body so as to apply a load to the front and back of the ski body, the suspension system being configured to contribute at least 20% and up to 100% to the resistive force that must be overcome in order to deflect the ski body from the flat, totally linear state to a state of positive deflection, the remaining resistive force that must overcome being contributed by the ski body.

In a further aspect, the invention features a suspension system that can be connected to the ski body, the suspension system being configured so that the additional force which must be applied to deflect the ski body from 0.25 inches deflection to 0.50 inches deflection is at least 10% less, and can be 95% less, than the force which must be applied to deflect the ski body from 0.0 inches deflection to 0.25 inches deflection, and at a predetermined degree of deflection the ski body will exhibit a spring rate between 10% and 98% less than the maximum spring rate exhibited prior to said predetermined deflection.

Some implementations may include one or more of the following features. The suspension system may be connected to the ski body by a mounting/linkage system, the mounting/linkage system being configured so that when the ski body is flexed beyond a predetermined degree of deflection the load applied to the ski body by the suspension system decreases or exhibits a decreasing spring rate. The suspension structure may be configured to apply a preload to the ski body when the ski is in the normal unloaded state, i.e., a state in which any significant deflection is precluded until the force applied to the ski body exceeds a predetermined amount, as will be discussed below with reference to FIG. 3A. The suspension system may also be configured to provide an increased spring rate when flexed beyond a predetermined state of deflection.

All parameters in the claims are measured as discussed below with reference to FIG. 3A.

The details of one or more implementations are set forth in the accompanying drawings and the description below. Other features and advantages of the invention will be apparent from the description and drawings, and from the claims.

DESCRIPTION OF DRAWINGS

FIG. 3 is a graph illustrating bending deflection (in inches) as a function of force (in pounds) applied to the ski shown in FIGS. 1-2A, and, for comparison, to skis that are not preloaded.

FIG. 3A is a graphic illustration of the measurement methodology and nomenclature used herein.

Like reference symbols in the various drawings indicate like elements.

DETAILED DESCRIPTION

Figure 1:
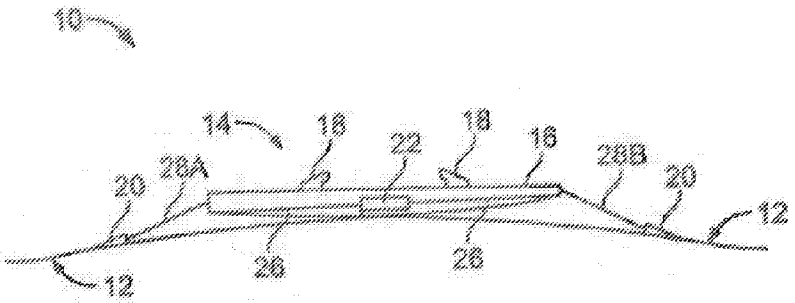
FIG. 1 is a side view of a ski according to one implementation of the invention.

Referring to FIG. 1, ski 10 includes a suspension system 14, described in detail below. The suspension system 14 is designed and constructed to optimize the spring rate of the ski, without spring rate being compromised in order to optimize the gliding/carving function or other characteristics of the ski.

Referring to FIG. 1, ski 10 further includes a ski body 12 that functions as a 'runner' or 'glider'. Ski body 12 includes a slippery running surface and edges for engaging the snow/ice. However, unlike the conventional alpine ski construction discussed above, ski body 12 does not primarily determine the spring rate of the ski. As a result, the design of the ski body, including shape, size, and materials, can be optimized for sliding over and/or engaging snow and ice, without needing to significantly compromise these performance characteristics in order to obtain a desired spring rate. While the suspension system will perform optimally with a ski body specifically designed to exploit its unique capabilities, the suspension system can also be attached to conventional ski bodies and exhibit similar performance improvements and characteristics.

It is this separation of the gliding/carving function and the spring function of the ski into two separate dedicated components (the ski body 12 and the suspension system 14) that facilitates the preload and low spring rate described above.

FIG. 3A illustrates the method used to measure the spring rates and preload. Points A and B denote the points along the long axis of the ski at which the ski has its maximum width at the front and back of the ski respectively. These points typically coincide with the points at which the ski curls upward when its base is held against a flat surface. The distance between these points is the contact length of the ski, i.e., that portion of the ski that actually engages a hard snow surface. This distance is substantially bifurcated at point X, typically the structural center of the ski, which is also typically denoted by the "boot center mark." The distances between X and A, and between X and B are labeled "Forward contact length: $C_F$" and "Rear contact length $C_R$," respectively. During all measurements, the ski is supported at points A and B only.

With the ski supported only at points A and B, a downward force is applied at point X, which will result in the center of the ski bending downward between points A and B as shown in FIG. 3A. For a given force applied at X in this manner, the resulting downward displacement of point X from the initial position, with no force applied, to the position with the force applied, is referred to herein as the deflection.

FIG. 3 graphically illustrates the unique preload performance characteristics of the suspension system with ski(s) shown in FIGS. 1-2A, 4A, 10, & 21 relative to skis that have no such suspension system and are not preloaded. The novel preload feature of the ski(s) with suspension shown in FIGS. 1-2A, 4A, 10, & 21 maintains a minimum predetermined pressure on the tip and tail of the ski at all times, even before significant bending and deflection begins (far left, Plots A-D). When deflection (and turning) begins, the tip and tail are already pressured sufficiently to carve a stable turn. Conversely, the graphs of skis that have no suspension system and are not preloaded (Plots E-G) depict a straight and virtually linear relationship between deflection and force, with no significant pressure on the tip and tail prior to bending/deflection. In addition, such skis must experience significant deflection before the tip and tail receive significant pressure.

The shaded portion of FIG. 3 (below 20 pounds pressure) represents the area where a ski will be relatively unstable due to insufficient loading of the tip and tail. The preload feature of the skis shown in FIGS. 1-2A, 4A, 10, & 21 ensure that the ski operates above and outside this area of potential instability over the entire range typical of recreational skiing. Conversely, the un-preloaded conventional skis (Plots E-G) operate almost exclusively within this area of instability over the entire range typical of recreation skiing. Even if extremely deflected above the region of instability, a conventional ski must always pass through this area again before the ski becomes sufficiently loaded to carve a stable turn in the opposite direction. This is why it is so difficult to smoothly transition from a turn in one direction to one in the opposite direction with such skis. The skis shown in FIGS. 1-2A, 4A, 10, & 21 easily steers from left to right without having to circumvent a significant zone of instability. As a result, a carving skier can steer himself to create almost any trajectory or path in a manner similar to an inline skater or bicyclist.

Because the preload pressure immediately brings the ski into the desirable operating zone, the spring rate thereafter is significantly less than a ski without a preload. Measuring as previously described, the skis depicted in Plots E-G have spring rates typically in the range of 15 lbs./inch up to 35 lbs./inch as indicated in FIG. 3 by plots E and G respectively. The spring rates shown in plots E and G are exhibited by many soft flexing recreational skis (Plot E) and very stiff racing skis (Plot G). A spring rage of 25 lbs./inch (Plot F) is exhibited by many conventional medium to stiff recreational skis. The skis shown in FIGS. 1-2A, 4A, 10, & 21 will typically exhibit from 15 lbs. to 45 lbs. of preload before significant deflection and turning begins (A=20 lbs., B=25, lbs., C=30 lbs., D=35 lbs.), and thereafter a spring rate of from 5 lbs./inch to 15 lbs./inch, which is about half the spring rate range of the skis shown in Plots E-G. It is this reduced spring rate after deflection begins that provides the supple ride and the enhanced steering response of the skis shown in FIGS. 1-2A, 4A, 10, & 21.

FIG. 3 Plot D also illustrates a three-stage spring rate suspension system, where a first initial extremely high spring rate when deflected from the unloaded state is followed by a second low spring rate for further deflection, followed by third spring rate higher than the second spring rate for yet further deflection.

In addition, it can be seen from FIG. 3 that conventional skis without the suspension can only effectively pressure the tip and tail when the ski is deflected from flat into a significant upward arc as over concave terrain. Such skis have no means to deflect into a downward arc from flat when the ski is on convex terrain or improperly pressured. Conversely, the ski 10 of FIG. 1 with the suspension system uniquely pressures the tip and tail consistently from −1.5" of downward deflection through 1.5+" of upward deflection thus maintaining full contact and control over all shapes of terrain and regardless of improper skier stance and balance.

Figure 2:
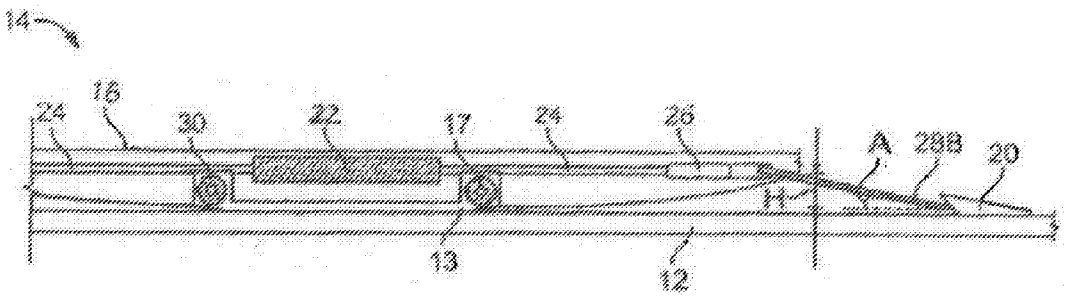
FIG. 2 is an enlarged side view of the right-hand two-thirds of FIG. 1 with the binding omitted.
Figure 5:
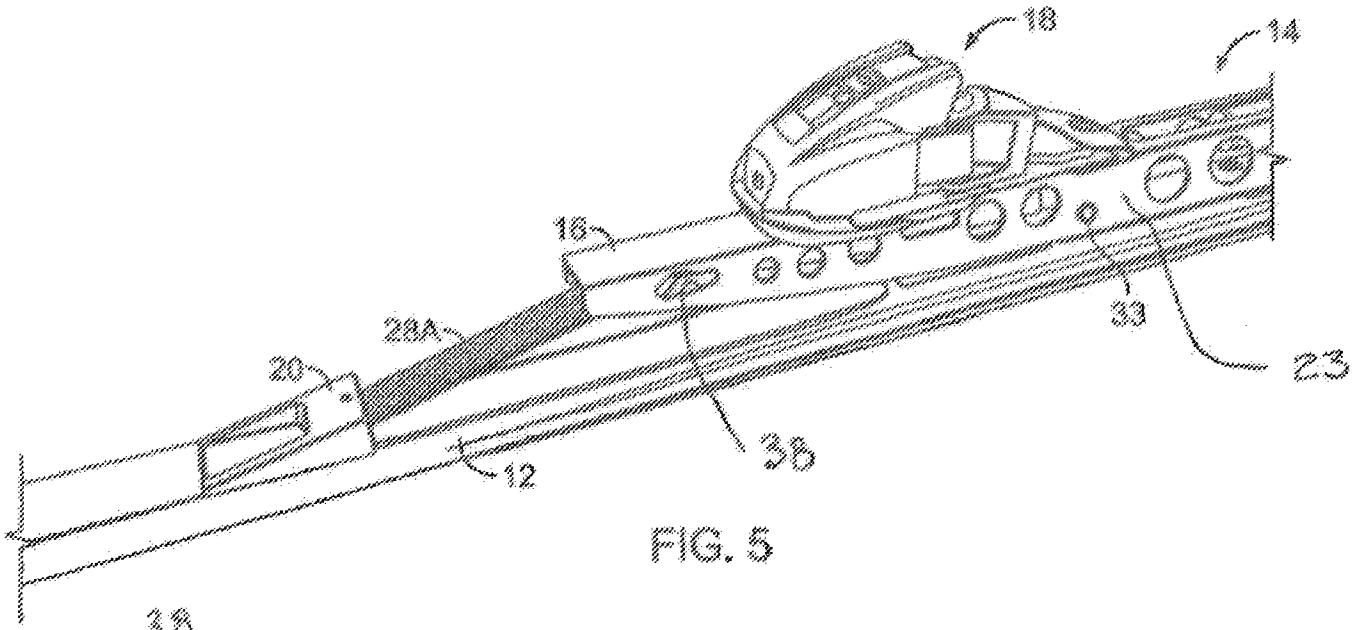
FIG. 5 is a perspective view of a front portion of the ski of FIG. 1.
Figure 5A:
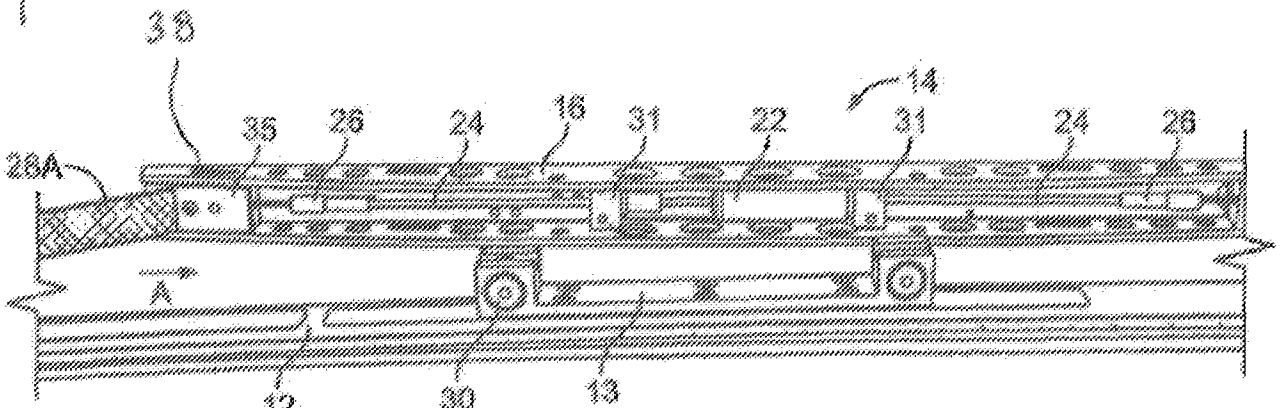
FIG. 5A is a partially exploded view, showing the beam/suspension/support assembly removed from the ski body.
Figure 5B:
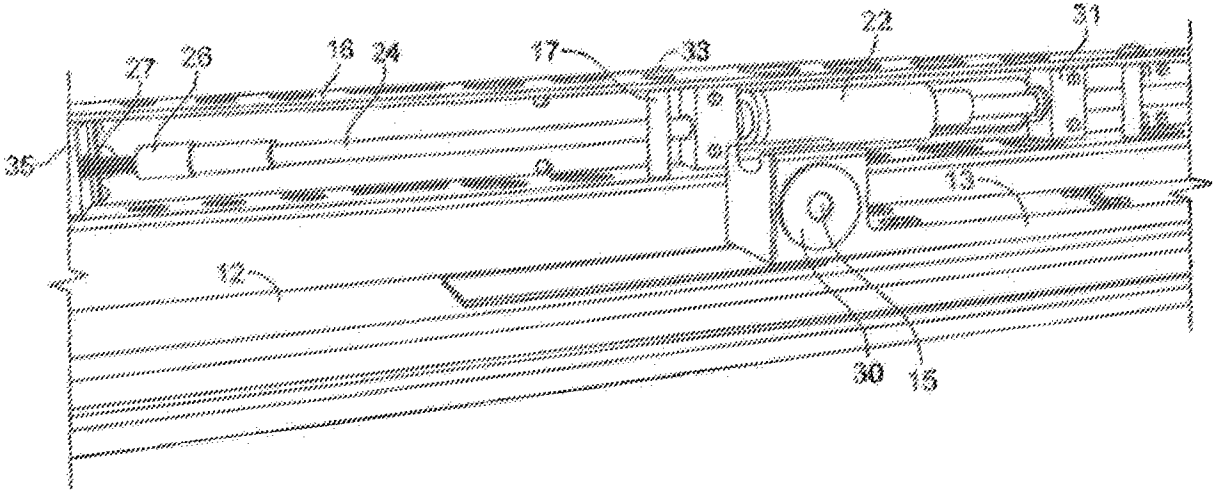

Referring to FIGS. 2 and 5A-5B, the suspension system 14 may be housed in a substantially rigid support structure 16. Support structure 16 is preferably a beam that is generally U-shaped in cross-section, as shown. The support structure 16 may be formed from aluminum, and may include a plurality of holes or cutouts formed therein to reduce the weight of the beam. In addition to supporting the suspension system 14, the support structure 16 also supports the binding system 18 (FIGS. 1 and 5), to which the boot attaches. The support structure 16 is connected to the ski body 12 by a mounting system that includes resilient couplings 30 which may be formed, e.g., of an elastomer, and mounting brackets 13. The mounting system may include any desired number of resilient couplings and brackets, e.g., two or more resilient couplings and one or more mounting brackets. Couplings 30, in conjunction with the mounting bracket(s) 13, allow movement of the support structure 16 in two of three directions, but do not allow any significant relative yaw or roll between the support structure 16 and the ski body 12. The support structure 16 is attached to the mounting bracket(s) 13 by pins 17 (FIG. 5B) that extend through a bore 15 (FIG. 2A and 5B) in the resilient coupling 30, which is held in bracket(s) 13, which is in turn attached to or integral with the ski body 12. In this implementation the pins 17 are internally threaded, and support structure 16 is screwed firmly to the pins 17 by screws 33 (FIGS. 5 and 5B) which are threaded into the pins 17 at each end (the screws are only visible on one side in FIGS. 5 and 5B). The length of each pin 17 corresponds substantially exactly (typically within ±0.005) to the outside width of the support structure 16, and thus each end of the pin is flush with the corresponding outer side wall 23 of the support structure 16. When the screws 33 are tightened down against the outer side walls, the engagement of the screw head with the side wall on each side of the support structure 16 contributes to the structural integrity of the support structure 16, preventing the side walls from being spread apart by forces encountered during skiing.

Figure 2A:
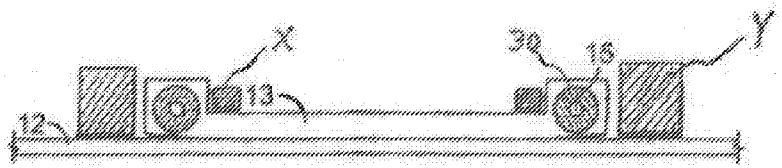
FIG. 2A is a side detail of a portion of FIG. 2.
Figure 2A:
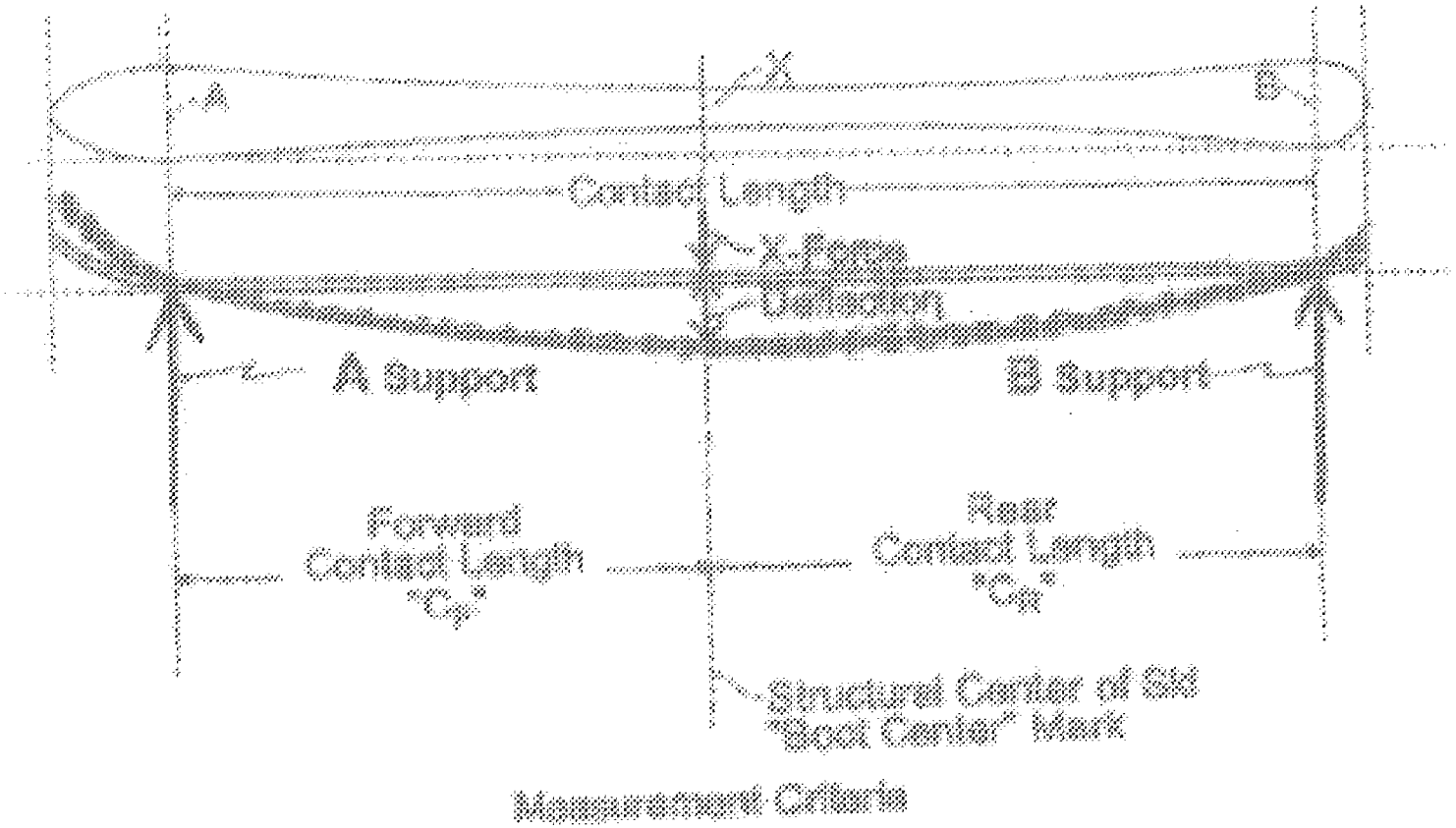

Referring to FIG. 2A, additional elastomer blocks X and Y may be optionally used for applications requiring greater resilient support for large downward compressive forces. The shaft support blocks 31 (FIGS. 5A and 5B) are supported by elastomer blocks X, which thus share the downward compressive forces of the beam 16 with the resilient couplings 30. Elastomer block Y, which fits between the ski body 12 and the beam 16, with clearance for shafts 24, is compressed as the runner 12 deflects into an arc. When compressed in this manner, elastomer blocks Y transmit downward forces from the beam 16 directly to the ski body 12. Because the elastomer blocks Y are located further from the longitudinal center of the ski body 12 than any part of mounting bracket 13, they impart additional pitch stability to the beam 16 and move the effective cantilevered hinge points of the ski body 12 further from the longitudinal center of the ski, which creates greater overall stability under extreme loading.

This pinned attachment of the support structure 16 to resilient couplings 30 also allows the support structure 16 to be easily removed, allowing the assembly of the support structure 16 and suspension system 14 to be removed and replaced by the user of the ski 12. This removability allows the user to interchange suspension systems having different performance characteristics, and also allows the user to remove the support structure/suspension system assembly to facilitate transport and storage of the ski and/or to prevent theft of the assembly. If desired, the screws 33 may be replaced by locking fasteners for which the ski owner has the key, reducing the likelihood of theft when the ski owner chooses not to remove the assembly from the ski body at a ski area or other public place.

The support structure 16 maintains a close side-to-side tolerance with the bracket(s) 13, which precludes any yaw and roll motion between the two parts. In addition, a thin bearing film such as UHMW polyethylene or PTFE (Teflon) may be used between the support structure 16 and the bracket(s) 13 to reduce wear and preclude galling. (Not shown.) On the other hand, the resilient couplings 30 allow the pins 17, and thus the support structure 16, some damped movement up/down and fore/aft. This resilient suspension of the support structure 16 over the ski body 12 helps isolate the user of the ski from shocks and vibration. This movement also allows a slight rotation of the support structure 16 about the pitch axis relative to the ski body 12 when a skier becomes fore/aft imbalance, which in turn alters the geometry of the suspension to create a greater down force on that portion of the ski body that would otherwise become light and unstable. For reasons of economy, the resilient components may be eliminated and the support structure can be attached directly to the ski body.

Figure 6:
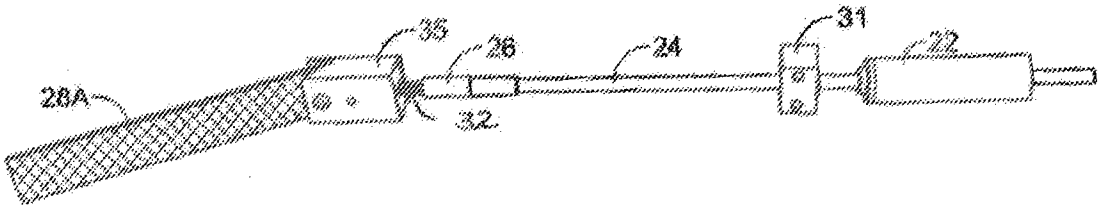
FIG. 6 is a perspective view of the rear half of the suspension sub-assembly.

The support structure 16 can carry a main spring 22. Main spring 22 is normally in a highly compressed state, typically in the 30 lb to 220 lb range. In the implementation shown in FIGS. 1-2A and 5A-5B, the spring may be, for example, a gas spring having a stroke of approximately 1-1.5 inches and a force ratio of approximately 1:1.4 from initial movement to end of stroke. For reasons of mass centralization and low moment of inertia, the spring 22 is typically located in approximately the center of the ski body 12, directly under the binding system 18. Referring to FIGS. 2, 5A and 6, the spring 22 is connected via shafts 24 and linkage 26 to the fore and aft struts 28A, 28B, which engage the ski body 12 through couplings 20 as will be discussed below. Each of the shafts 24 is supported by one or more support blocks 31 (while one block is shown in FIGS. 5A and 6, in some implementations each shaft 24 is supported by two blocks, one at each end of the shaft) which are firmly mounted on support structure 16. As the front and back of the ski body 12 bend upwards into an arc, the couplings 20 push the struts 28A, 28B inwards into the support structure 16 (see arrow A, FIG. 5A), compressing the main spring 22 through the linkage 26 and shafts 24. This unique spring/suspension system helps provide the dynamic characteristics discussed herein.

Figure 7:
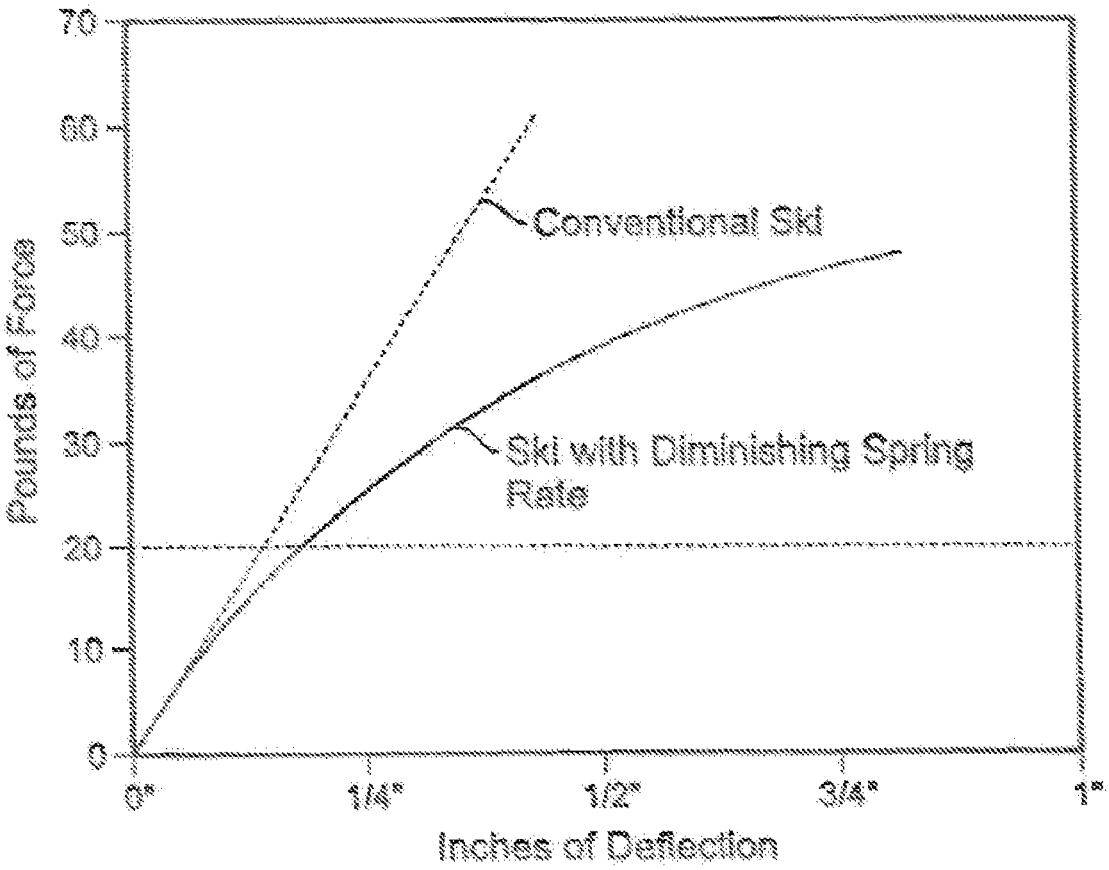
FIGS. 7-9 are graphs illustrating the performance (spring rate) characteristics of various skis.
Figure 8:
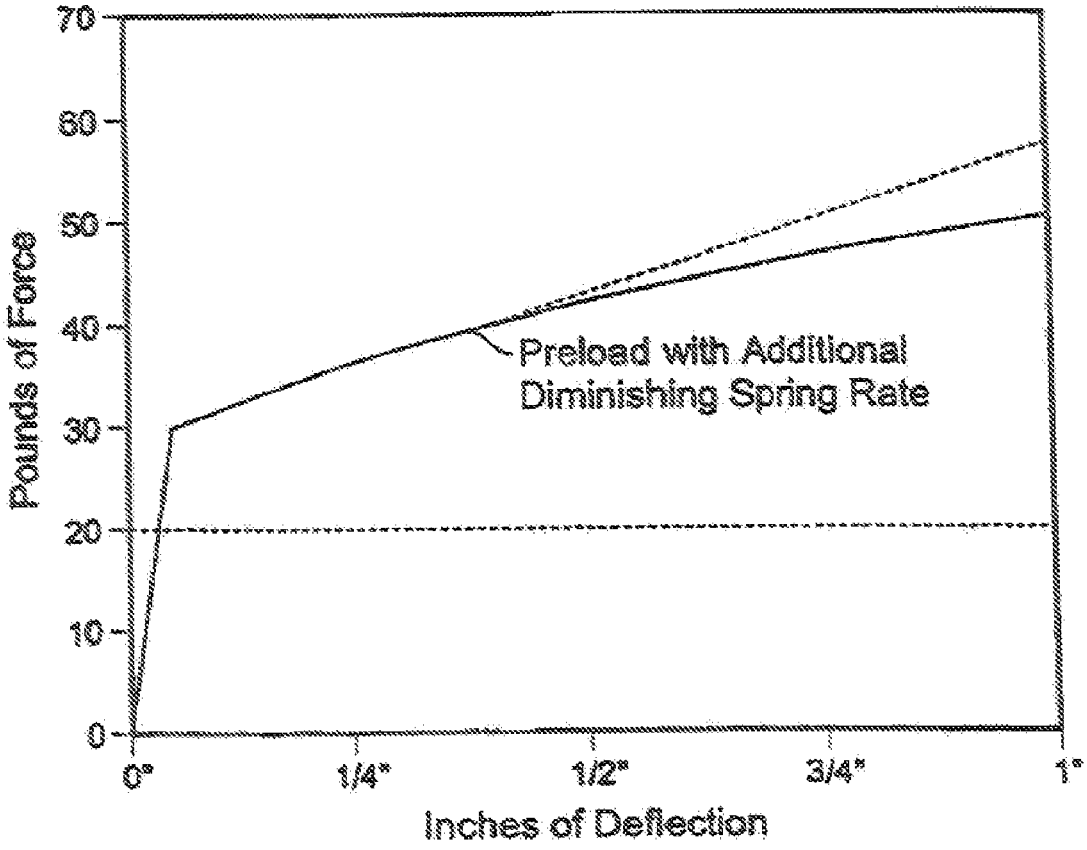

It is noted that the arrangement of struts 28, linkages 26 and shafts 24 relative to the ski body 12 may be configured so that the ski exhibits a diminishing spring rate beyond a certain degree of flexure, as illustrated graphically in FIGS. 7 and 8. When the spring rate diminishes in this manner, the ski will perform more and more like a "soft" ski when the ski body is dramatically flexed. This reduction in spring rate is the result of struts 28, linkages 26 and shafts 24 becoming generally collinear as the ski is flexed. Once these components are collinear, the spring 22 will cease to apply any significant additional force to the tip and tail of the ski upon further flexure. How much the ski must be flexed before this colinearity occurs (if it does at all) can be predetermined by, for example, adjusting the angle A (FIG. 2) between the strut 28 and a line drawn from the base of the strut 28 parallel to the upper surface of the ski body 12, and/or the height H of the point at which the strut 28 is joined to the support structure 16 above this line. To provide good leverage to the skier, it is generally preferred that H be at least 0.25", more preferably at least 0.5", and most preferably at least 1.0". Greater heights can also be effective. Angle A may be, for example, about 3 to 40 degrees, and preferably about 5 to 15 degrees.

The linkage 26 can include adjustable elements that can be used to set the camber of the ski to any desired level. These adjustable elements allow the effective length of shafts 24 to be adjusted, thus pushing the tip and tail up or down via struts 28 and couplings 20, which decreases or increases "free camber" respectively. For example, as shown in FIGS. 5B and 6, the linkage 26 may include a threaded portion 32 that allows the length of shaft 24 to be adjusted by screw adjustment, i.e., by threading the threaded portion 32 of linkage 26 in and out of an internally threaded block 35 secured at one end of the strut 28. Optionally, the threaded block 35 may be retained in its desired position under support structure 16 by pins (not specifically shown) secured into the body of the threaded block 35 that extend into a slot 38 formed in the support structure 16. In this pin and slot arrangement, the threaded block 35 is allowed to move longitudinally with respect to the support structure 16 but cannot become completely disengaged from the support structure 16 until the pins are removed. Under conditions where the terrain may be severely undulated, adjusting the ski to have additional camber allows the ski to bend into an exaggerated concave shape when the tip and/or tail would otherwise have become unloaded. This creates a 'long travel suspension' that will keep the tip and tail of the ski in contact with the snow for better control and stability.

Moreover, referring to FIGS. 1 and 2, in the suspension system 14 the fore strut 28A is connected to the aft strut 28B by the shafts 24, which both terminate at opposite ends of the single main spring 22. This novel independent but linked suspension will automatically equalize the spring load on both fore and aft struts 28A, 28B. Typically with a conventional ski, when the skier encounters a bump, the front of the ski is bent upwards and the skier is thrown backwards to the soft, as yet unbent, tail. The skier literally has to fall backward in order to bend and load the back of the ski to match the front. The linked suspension system described herein responds uniquely to this same situation. Upon encountering a bump, the front of the ski will absorb much of the energy by compressing the suspension spring 22 to a higher pressure. Because of the continuous linkage, this same raised pressure is applied to the tail of the ski. The raised pressure on the tail of the ski helps keep the skier balanced against the backward thrust while also keeping the tip down for continued control and stability.

This linked suspension system creates a unique sense of stability for the recreational skier, absorbing and balancing forces that would normally be upsetting. Moreover, because the entire suspension/binding system assembly is resiliently mounted by couplings 30 (e.g., elastomer couplings) on the ski body (the running surface), vibrations and shocks directly underfoot are also effectively damped.

The suspension system and ski shown in FIGS. 1-2A and described above facilitates optimizing the various dynamic parameters to achieve maximum stability over the widest range of turn radii. For teaching beginners and other purposes for which a less sophisticated suspension system may be appropriate, ski 100, shown in FIG. 4A, presents a more economical approach.

Figure 4:
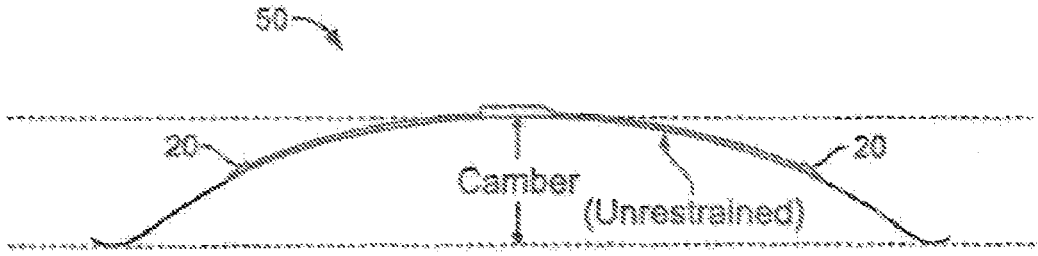
FIGS. 4 and 4A are side views of a ski before and after mounting of the camber restraining binding/suspension structure onto the ski, respectively.
Figure 4A:
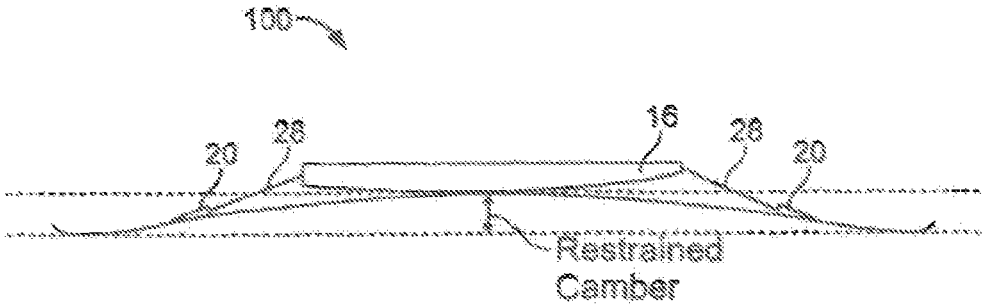

FIG. 4 shows a ski body 50 that is suitable for use as a runner for the ski 100 shown in FIG. 4A, before the spring suspension system and binding system are mounted. Ski body 50 is formed with an exaggerated free camber. The "unrestricted camber" of ski body 50 in FIG. 4 is typically in the range of 1 inch to 5 inches. The very low spring rate of the ski body 50 is also a significant departure from typical ski characteristics. Measured as shown in FIG. 3A and described above, the spring rate of ski body 50 of FIG. 4 would typically be in the range of 10 lbs./inch to 20 lbs./inch but could be in the range of 5 to 10 lbs./inch or 20 to 30 lbs./inch in the extreme cases of small children or heavy athletes respectively. Conventional skis typically fall within the range of 20 lbs./inch to 35 lbs./inch, which is approximately double that of the ski 50 in FIG. 4.

FIG. 4A illustrates a suspension system that comprises restraining elements. This implementation comprises a support structure 16, carrying the restraining/suspension system 14 and the binding system 18. The support structure is coupled to the ski body 50 by bracket(s) 13 and resilient couplings 30 that absorb shock and vibration while providing precise yaw and roll control. For economical reasons, the resilient couplings could be eliminated and a direct attachment used, e.g., screws or bolts.

After the support structure 16 is in place on the ski body 50, the assembly is compressed against a flat surface until a significant amount of the extreme camber has been eliminated. In this constrained state, a profile view of the ski body would look more like a conventional ski at rest, unloaded and uncompressed. While in this confined configuration, the two couplings 20 at the fore and aft of the ski are engaged with corresponding linkages 28 on the suspension structure. Upon removal from the constraining apparatus (FIG. 4A), the ski 100 remains in the relatively un-cambered, stressed state, as the rigid support structure 16, by way of the fore/aft couplings 20, and struts 28, prevents the ski body 50 from returning to the extreme concave camber configuration as shown in FIG. 4. The remaining camber is typically in the range of 1 inch to 2 inches, but could be less or greater. As such, this implementation also exhibits the novel characteristics of the ski with suspension system shown in FIGS. 1-2A, specifically a significant preload force and a low dynamic spring rate. The graphic load vs. deflection plots of this implementation would be similar to A-D of FIG. 3. This implementation can be manufactured using a relatively simple process. The support structure 16 can be injection molded plastic and the linkage 28, because it is in tension only, can be a simple length of cable. For economical reasons, the support structure 16 may also be eliminated and the simple length of cable from coupling 20 can be secured directly to a bracket of the proper dimensions affixed to the ski. For example, such a bracket could include a plate that fits under the boot binding and is thus affixed by being sandwiched between the boot binding and the ski body. The plate could include a plurality of holes to allow the boot binding mounting screws to pass through and thus positively retain the bracket.

In addition, length adjustment features can be incorporated into the couplings 20 and/or struts 28, and/or into the support structure 16 or bracket, that would allow the amount of camber to be easily adjusted. By lengthening or shortening the effective length of the restraining elements 28, the ski body 50 can be allowed to bend more or less in the unloaded state. Thus the static camber can be adjusted over a wide range from that of a conventional ski to an extremely long-travel concave shape.

Moreover, additional components, such as elastomers or springs can be employed in or between couplings 20, struts 28, and support structure 16 or a bracket to augment or modify the dynamic characteristics. For example, incorporating an elastomer where each strut 28 is joined to either support structure 16 or coupling 20 would damp the suspension 14 upon full extension as in a situation when the skier leaves the snow surface momentarily.

An alternate version of this implementation uses cables as the coupling members that limit the camber and create the preload force (i.e., struts 28 may be replaced by cables). Camber adjusters and spring tensioners can also be used in this system to adjust the camber and preload.

In another implementation, elements of the two previously described implementations can be combined. Thus, the ski 10 shown in FIGS. 1-2A can be modified to include a low spring rate ski body that has extreme concave camber in the unrestrained state. In such a case, the struts and couplings, together with the linkage and support structure, perform the restraining function (tension/unloaded) as well as the preload function (compression/loaded) as described above. The support structure could also include the elements illustrated in FIG. 11A that can create the characteristic of creating a point of deflection after which the spring rate is higher than the exhibited prior to such point of deflection.

A number of implementations have been described. Nevertheless, it will be understood that various modifications may be made without departing from the spirit and scope of the invention.

For example, the principles discussed above may be utilized to provide skis having a variety of performance characteristics. For instance, as illustrated graphically in FIG. 7, the ski may exhibit a diminishing spring rate without an initial preload. This may be accomplished, e.g., by mounting the suspension system/support structure assembly discussed above with reference to FIGS. 1-2A and 5-5B on a ski body having a very low spring rate (i.e., a very "soft" ski body) and using a spring having a relatively low spring rate (e.g., a coil spring) in the suspension system. Thus, prior to flexing the ski, the coil spring will apply only enough force to the tip and tail to cause the ski to perform like a conventional ski having average stiffness. As discussed above with reference to FIG. 8, as the ski is flexed beyond a certain point the spring will apply less and less additional force to the tip and tail for equal increments of deflection, and thus after the initial high spring rate preload, the ski will perform more and more like a soft ski as it is flexed more and more dramatically.

Figure 9:
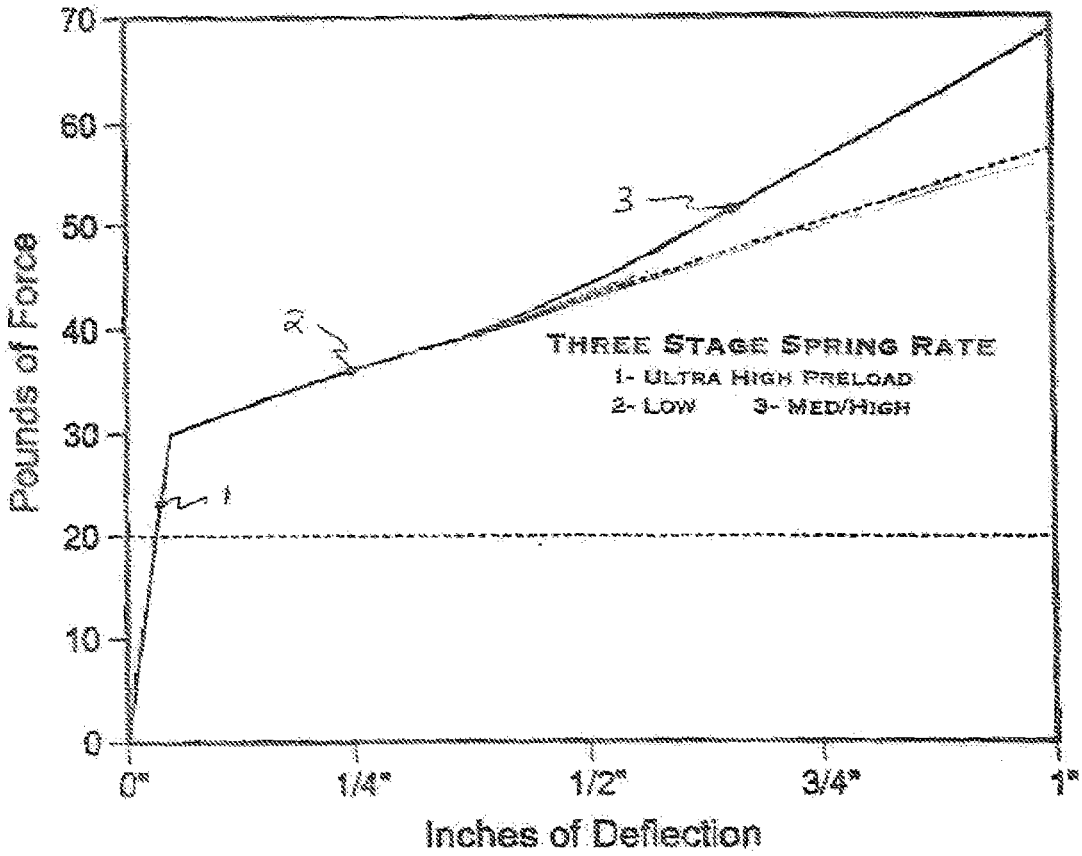

FIG. 9 graphically represents the high spring rate preload feature followed by the low spring rate region as in FIG. 8, but with the addition of a third region of increasing spring rate beginning at a predetermined point of deflection, which can be enabled by rigid or elastomeric elements located between the support structure and the ski body. (FIG. 11A).

Moreover, the suspension system implementations discussed above can be modified to incorporate the following features and/or elements either individually or in combination.

The ski body 12 to which the suspension system is connected can be a glider, conforming to the shape and dimensional characteristics taught in U.S. Pat. No. 6,857,653, issued Feb. 22, 2005 and titled "Glider Skis", the complete disclosure of which is incorporated herein by reference. For example, the ski body 12 could have a very narrow waist, e.g., 40 mm or less, and the tip and tail could be significantly wider, e.g., the ratio of the maximum tip and tail width to the waist width may be 2:× where $0.5 \leqq x \leqq 1.5$, as described in the above-referenced patent application. This ski body geometry would generally enhance the steering characteristics of the ski.

The ski body 12 to which the suspension system is connected may include a "tunnel edge" structure such as those described in U.S. Pat. No. 7,073,810, issued Jul. 11, 2006 and titled "Ski with Tunnel and Enhanced Edges," the complete disclosure of which is incorporated herein by reference. Such skis have a ski edge geometry and carving performance similar to that of an ice skate. One or more recesses or channels are introduced in the bottom running surface of the ski to expose the inner side of the ski edges. The channels run alongside the steel side edges of the ski. The running surface includes flat sections for preventing both edges from digging in at once and stopping a skier's forward movement. The presence of the channel exposes an inner side of the ski edge, so that during a turn, the ski edge acts like a skate blade and produces a dig angle with the snow surface compared to a skid angle produced by the plane of the running surface between the ski edges. This edge structure would enhance control under hardpack or icy conditions.

Figure 14:
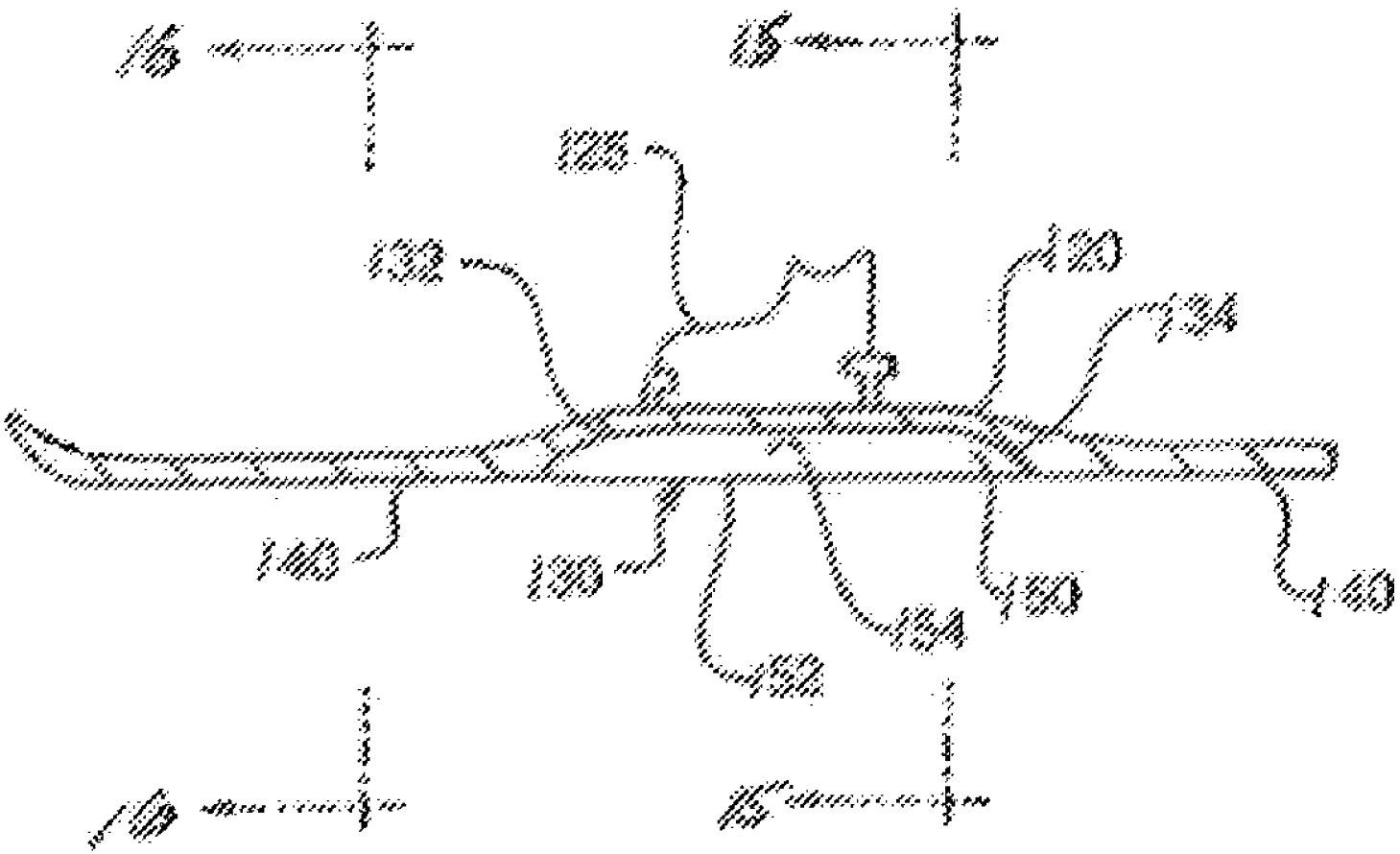
FIG. 14 is a sectional side elevation view of a ski with tunnel edges viewed from the longitudinal centerline of the ski, with the suspension system omitted.
Figure 15:
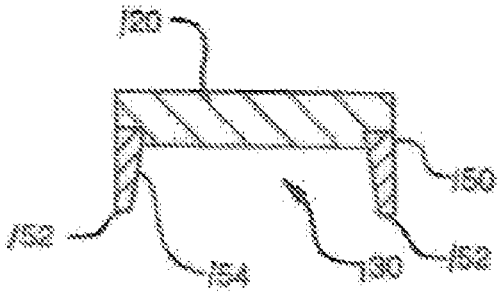
FIG. 15 is an end sectional view of the ski of FIG. 14 taken along line 15-15.

Examples of tunnel edged skis are shown in FIGS. 14-18C. FIG. 14 shows a ski 120 having a hollow or channel 130 formed in the running surface 140 beneath the area of the boot binding 125. The channel 130 has sloped front and rear ends 132, 134, which preferably gradually join the deepest part or ceiling of the channel 130 with the running surface 140. As shown in FIG. 15, the sides of the channel 130 are closed by ski edges 150, which are preferably made of steel and typically extend along the entire length of ski 120 except at the extreme tip and tail, but may be shorter or longer. The ski edges 150 adjacent the channel 130 are exposed on two or three sides, rather than just one or two, so that the inner side 154 is available to contact the snow. The bottom surface of the ski 120 adjacent the edges is recessed and does not contact the snow in hardpack or icy conditions. All of the downward force of the skier is supported only by the edge 150 in the area of the channel 30. As a result, the ski edges 150 at the channel 130 function similarly to ice skate blades during a turn because they are exposed on both the outer side and inner side 154, without additional surface to impede penetration. The skier's force in a turn is applied to the skiing surface through edge tip 152 and inner side 154, rather than through a corner of the edge 150 and running surface 140. The exposed inner ski edge 154 effectively turns the forces applied by the skier to the skiing surface by 90° so that the ski edge 150 is positively engaged with the skiing surface at a dig angle of some degree.

Figure 16:
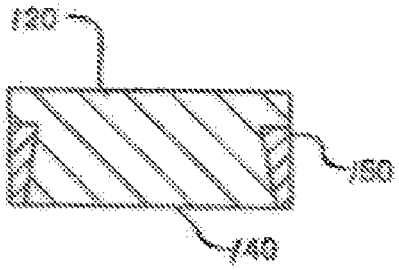
FIG. 16 is an end sectional view of the ski of FIG. 14 taken along line 16-16.

FIG. 16 shows the solid ski body 120 at the front end ahead of channel 130. At this location, ski edges 150 are exposed only on the outside and edge tip 152. Inner side 154 is mounted directly against ski body 120 and covered. As illustrated in FIG. 14, the channel 130 preferably extends through approximately the center third of the length of the ski 120, while running surfaces 140 of the front and rear thirds remain flat and smooth, and without channels. However, in alternate implementations channel(s) may run from 5% to 100% of the length depending on the terrain surface and intended application.

Figure 17:
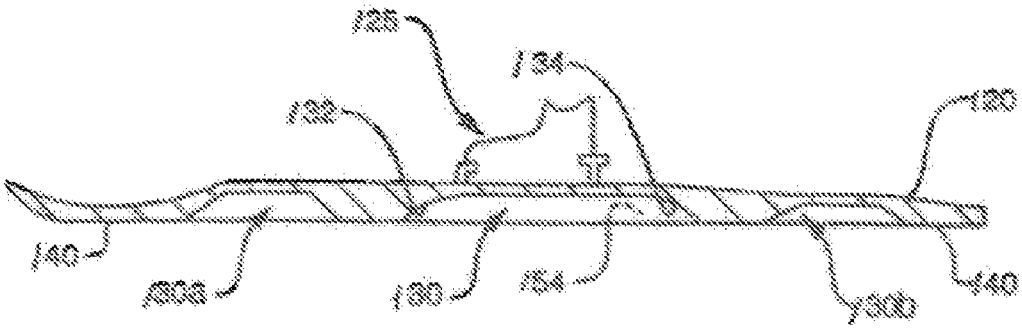
FIG. 17 is a sectional side elevation view of a ski with tunnel edges viewed from the longitudinal centerline of the ski, again with the suspension system omitted.

As shown by FIG. 17, the channel 130 may be discontinuous, with discrete channels 130 formed in two or more areas along the length of the ski 120. For example, a second channel 130*a* can be formed near the front end or tip of the ski 120, and a third channel 130*b* formed near the rear or tail of the ski 120. The channels 130*a*, 130*b* may have the same or a different shape as the channel 130 under the boot binding area of the ski 120. In each case, the front and rear ends of the channels 130, 130*a*, 130*b* are sloped from the channel ceiling to the running surface 140. The channel ceiling is preferably flat.

Figure 18A:
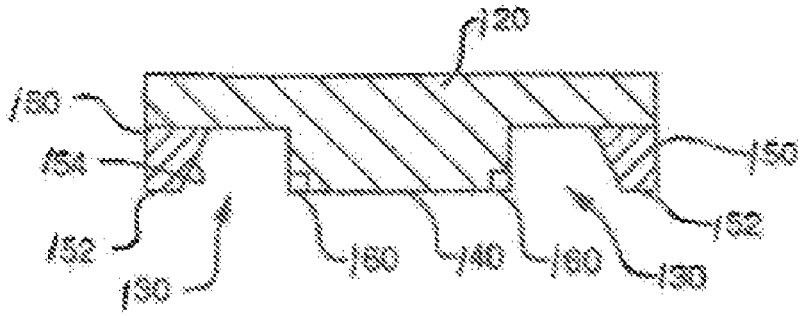
FIGS. 18A-18C are end sectional views of skis having tunnel edges with various channel shapes.
Figure 18B:
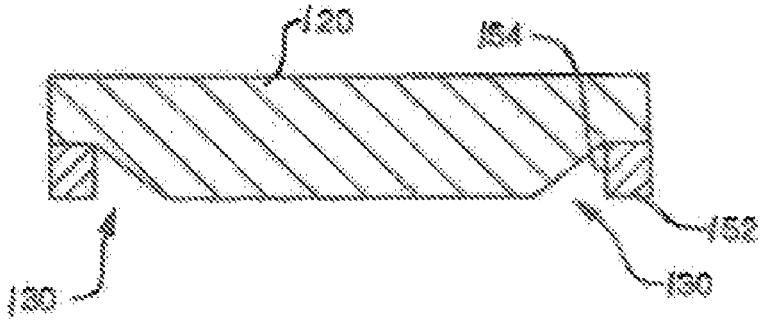
Figure 18C:
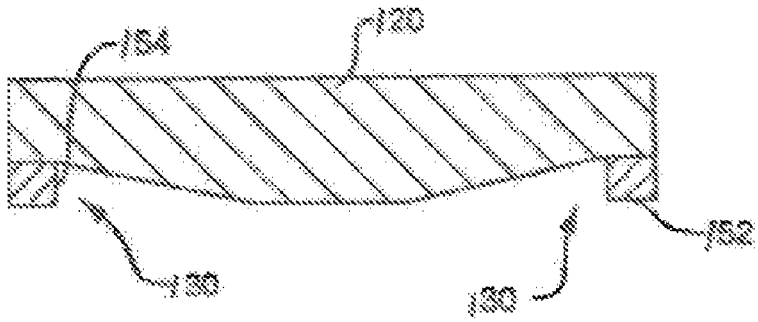

FIGS. 18A-18C show implementations in which the channel 130 is divided into two separate channels 130 in the running surface 140 on either side of the ski 120. The ski edges 150 each have exposed inner side 154 facing one of the channels 130 for contacting the snow surface. The running surface 140 is preferably flat, and may have second edges 160, as illustrate in FIG. 18A.

The coupling of the suspension system 14 and a ski body 12 can incorporate a quick release means, allowing the ski body 12 and suspension system 14 to be easily and rapidly disengaged. This would allow a skier to travel with one pair of suspension/boot binding structures together with several pair of ski bodies, each optimized for different conditions.

The main spring 22 can incorporate a quick-change feature, allowing it to be easily exchanged for an alternate main spring with a different preload and/or spring rate.

The struts 28A, 28B (FIG. 1), which are normally in a state of substantially pure tension or pure compression, can be configured with a rotational moment that can apply an upward or downward force to the ski body 12 in addition to the tension/compression forces. This can be achieved through springs, torsion bars, and/or elastomers. Moreover, greater or lesser preloads and spring rates may be used.

Figure 10:
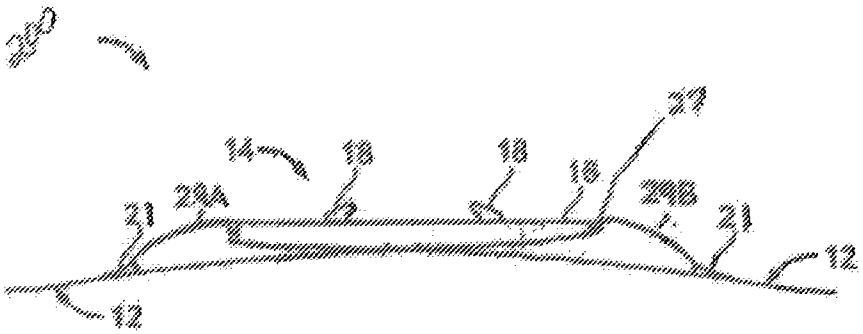
FIG. 10 is a side view of a ski that employs dual leaf springs.
Figure 11:
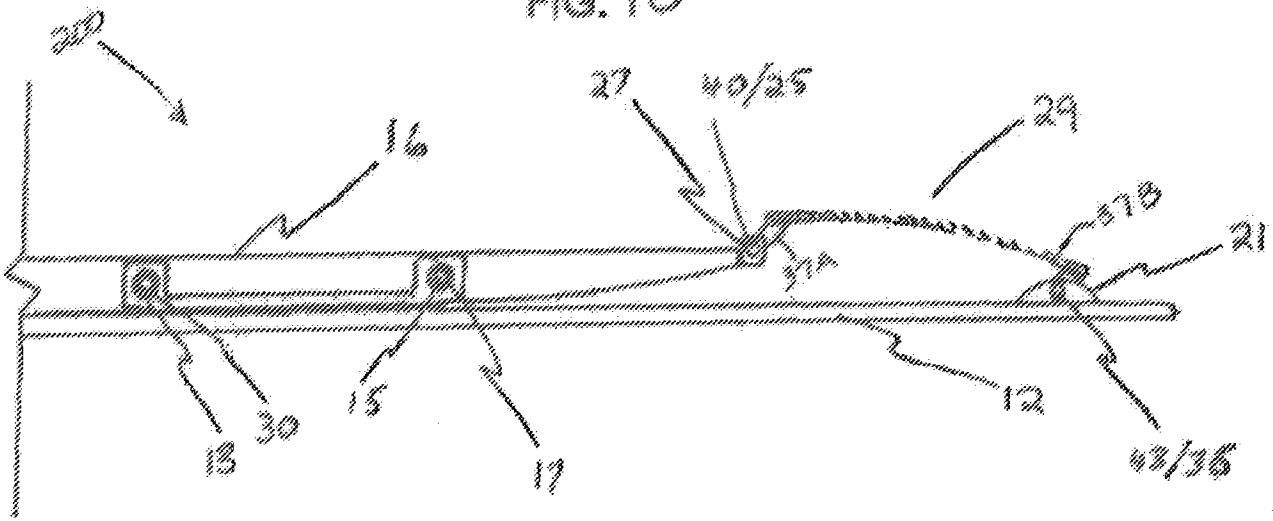
FIG. 11 is an enlarged view of a portion of FIG. 10.
Figure 11A:
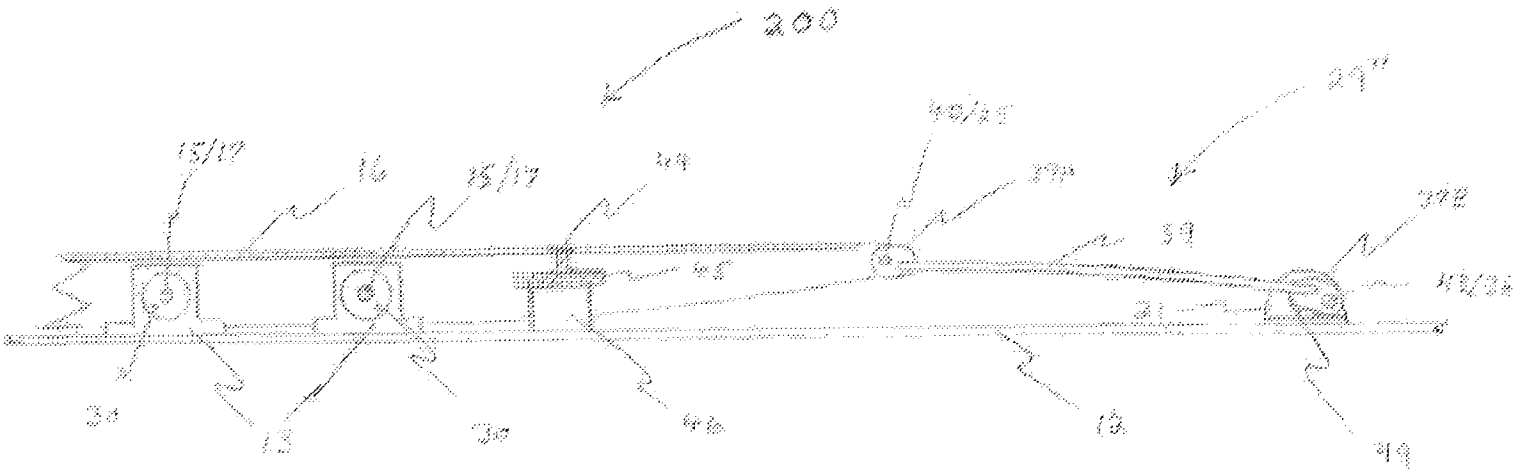
FIG. 11A is an enlarged, more detailed view of a portion of FIG. 11.

Another implementation is shown in FIGS. 10, 11, and 11A. Similar to the previously described implementations, the suspension system with ski 200 is comprised of a ski body or runner 12 with an attached mounting bracket(s) 13, a support structure 16 secured to bracket(s) 13, and spring brackets 21 (FIGS. 2, 11, and 11A). Referring to FIGS. 10, 11, and 11A, ski 200 is also similar to the previously described implementations in that it comprises a support structure 16, which mounts to the ski body 12 with pins 17 as discussed above.

In lieu of the centrally located main spring and linkages of the previously described implementations, the support structure 16 in this implementation comprises spring mounting brackets 27 that are attached to both ends of the support structure 16, with the method of attachment allowing the location of the brackets 27 to be longitudinally adjustable by a small amount within the ends of the support structure 16 such as by having brackets 27 slide in or out within the support structure 16 after the bracket mounting screws (not shown) have been loosened. Such longitudinal adjustment will increase or decrease the force of the spring upon the ski body 12 at any specific deflection to compensate for differences in the weight of the skier or changes in snow conditions. Alternately, the spring mounting brackets 27 can be functionally incorporated into the support structure 16 directly eliminating the need for separate pieces (FIG. 11A).

Figure 12A:
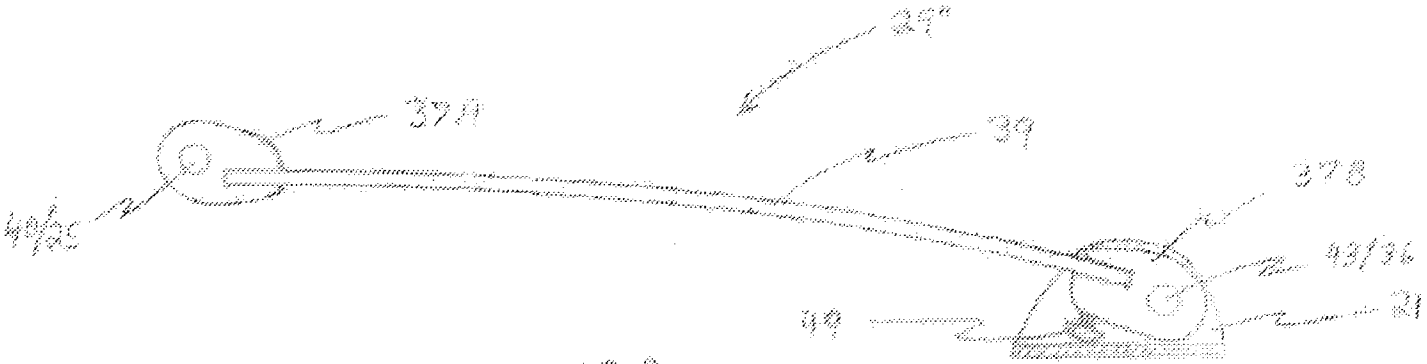
FIG. 12A is an enlarged view of the leaf spring assembly of FIG. 11A.
Figure 12:
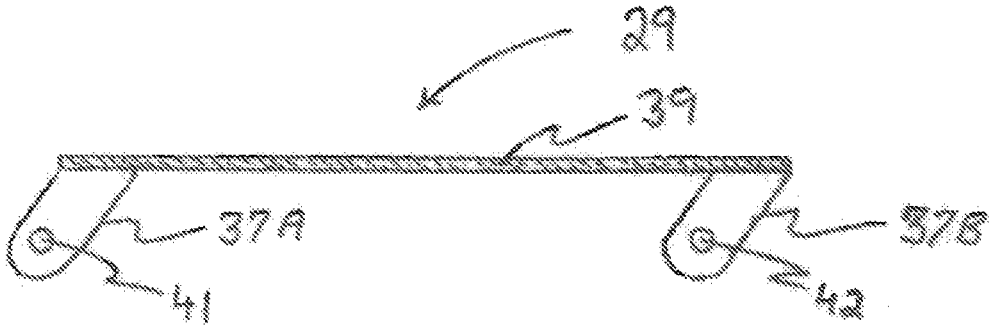
FIG. 12 is a side view of a leaf spring assembly.

FIG. 12 is an enlargement of one of the spring assemblies 29, which includes a resilient component 39 with attached mounting bosses 37A and 37B secured or formed at each end. As illustrated in FIGS. 10-13 the resilient component 39 can be a leaf spring or bow spring made of a composite of resin and fiber such as epoxy and fiberglass, carbon, or Kevlar, or a spring tempered metal. Alternately the resilient component 39 can be selected from a group including but not limited to, coil springs, torsion springs, elastomers, gas springs, and gas shocks. In addition, such resilient components can include a damping element. Each of the spring assemblies 29 is connected at its opposite ends to the support structure 16 and the ski body 12, for example using pins 25 and 36, as shown in the figures. Thus, boss 37A of each spring assembly 29 is connected to the support structure 16 by a pin 25, which passes through both a hole 40 in the leaf spring mounting bracket 27, or in the ends of support structure 16 (FIG. 11A), and a corresponding hole 41 in the boss 37A. The other boss 37B is connected to the ski body 12 by a pin 36 that passes through both a hole 43 in the bracket 21 (FIG. 11, 11A, and 12A) and a corresponding hole 42 in the boss 37B (FIGS. 11A, 12, and 12A). The pins 25 and 36 can be drilled and tapped at both ends to accept screws that will retain the pins after insertion or other means of retention can be employed.

Ski 200 functions with the same performance characteristics and benefits of the previously described implementations because flexing of the ski body 12 into an arc compresses the spring assemblies 29, creating a downward force on the ski body through brackets 21. Moreover, when resilient component 39 is a leaf spring or bow spring as illustrated in FIGS. 10-13, the general dynamic characteristics of compressing a bow or leaf spring, coupled with the specific and novel geometric dimensions of this configuration, creates the unique and desirable performance of an immediate, extremely high spring rate "preload" followed by a significant region of very low spring rate as compression commences and continues respectively.

Figure 13:
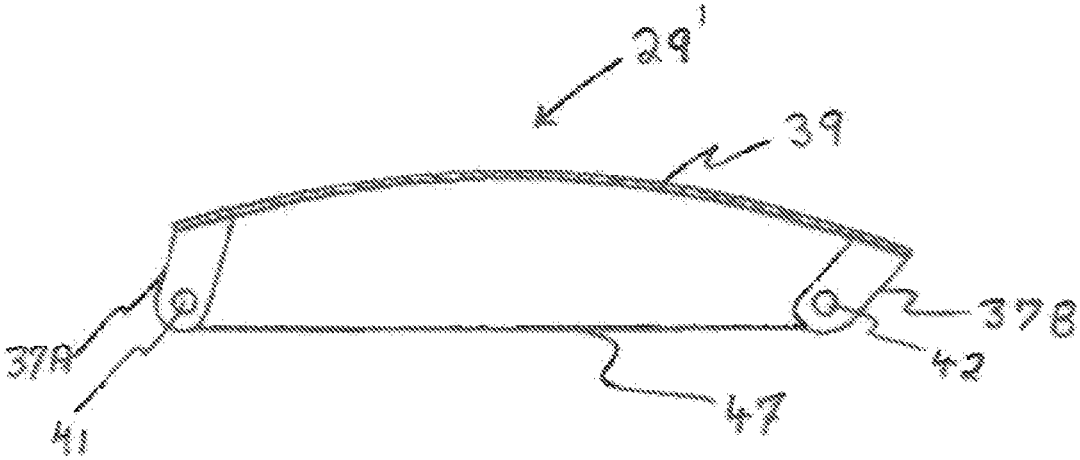
FIG. 13 is a side view of the leaf spring assembly of FIG. 12 with a pretensioner installed.

FIG. 13 is a side view of a leaf spring assembly 29' similar to that shown in FIG. 12, but with a preload tension 47 attached. The preload tensioner 47 in this implementation is a stainless steel cable that is attached to the ends of bosses 37A and 37B while the leaf spring is held in a state of compression. The preload tensioner 47 can also be a solid rod attached between the two bosses 37A and 37B in a manner that precludes the bosses from moving apart, but does not restrict the bosses from moving closer as when the leaf spring encounters additional compression. The preload tensioner 47 can also be a rigid structure attached directly to the resilient component 39 while it is in the compressed state such that the resilient component is constrained to the minimum are created by the compression but is free to arc further upon additional compressive force. When the compressive force is removed, the preload tensioner 47 prevents the bosses 37A and 37B from moving away from each other, keeping the resilient element 39 in a constant state of compression. When the leaf spring element 29' is installed in a ski similar to ski 200 shown in FIGS. 10 and 11, the ski will exhibit the preloaded characteristics previously described. The pretensioned leaf spring assembly 29' will preclude movement of the bracket 21 until the pretension force is exceeded. More importantly, the downward pretensioned force of the leaf spring assembly 29' is transferred to the ski body 12 by the bracket 21 even before the ski body experiences significant deflection. Such pretensioning typically creates a downward force on the ski body at each of the brackets 21 of between 7 lb. and 25 lb. within the first quarter inch of deflection.

FIG. 12A is a side view of a leaf spring assembly 29" (that is also shown in FIG. 11A), which is similar to that shown in FIG. 12, but with the addition of a preload tensioning screw 49. Whereas in the configuration illustrated in FIGS. 11 and 12, the boss 37B is free to rotate to any angle relative to bracket 21 and pin 36, the screw 49 of assembly 29" acts as an adjustable stop against the bracket 21 that limits the rotational angle of boss 37B relative to bracket 21 when the resilient element 39 straightens approaching full camber. When screw 49 hits the bracket 21, rotational movement of boss 37B is halted maintaining the spring component 39 in a tensioned state. The effect of this configuration is similar to that of the configuration shown in FIG. 13 with the pretensioning element 47.

Figure 19:
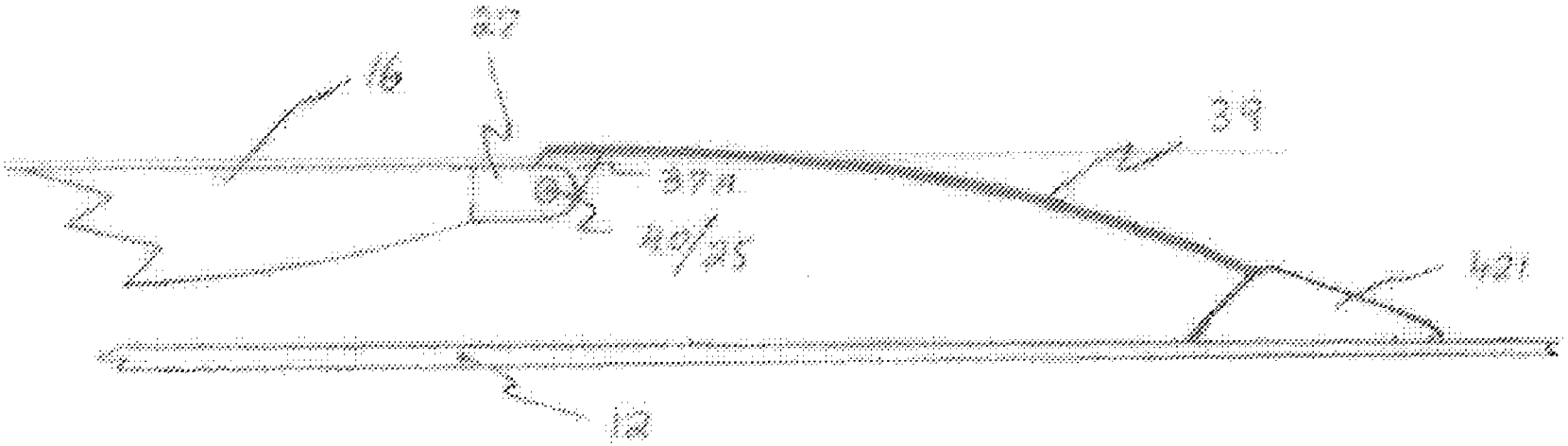
FIG. 19 is a side view of an alternate implementation in which the ski includes a dual leaf suspension with an integral pretensioner arrangement.
Figure 19A:
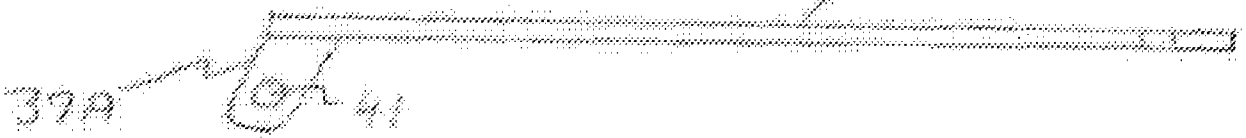
FIG. 19A is a side view of enlargement of a portion of FIG. 19.

An alternate implementation of this suspension design with preload feature and diminishing spring rate is illustrated in FIG. 19. In this implementation, the bracket 21 and hole 43 shown in FIG. 11 is replaced by a bracket 421 to which the resilient component 39 is directly attached. This modification also eliminates pins 35 and bosses 37B (FIGS. 12 & 19A). The bracket 421 is designed to solidly hold the resilient component 39 at a specific angle relative to the top of the ski body 12, typically between 15 and 30 degrees. With this angle optimized, the resilient component provides all the desirable spring characteristics discussed above while the ski body 12 itself provides the restraining and pretensioning function, eliminating the need for the pretensioning cable 47 (FIG. 13) or other specific pretensioning or restraining component.

All the aforementioned suspension system implementations comprising the support structure 16 can also include a system to increase the spring rate and stiffen the ski when the ski is deflected beyond a predetermined amount. As shown in FIG. 11A, one or more resilient or rigid elements 46 are incorporated into the support structure 16 in the regions between each mounting pin 17 and the respective end of the support structure. The said resilient or rigid element(s) can be affixed to a threaded ring 45 which is in turn threaded onto a stud 44 that is affixed to the support structure 16. By turning the ring 45, the clearance between the resilient or hard element 46 and the ski body 12 can be increased or decreased, which will determine at what degree of deflection the ski body 12 will contact the elastomer or rigid element 46. Prior to such contact, the longitudinally central region of the ski body 12 is predominantly pressured downward by the two pins 17 and the ends of the ski body are free to bend upward uninhibited into a pure arc. After such contact, the resilient or hard elements 46 impede further upward deflection by creating a counter bending moment by functioning as a downward fulcrum with pins 17 respectively pulling upward. After such contact, additional deflection of the ski will exhibit a rapidly increasing spring rate and overall stiffening. With this feature the ski can have a dual flex pattern being relatively flexible in the cruising and carving range for easy control and maneuverability yet immediately stiffening when more extreme skier input is applied. Moreover the transition point is fully adjustable by turning rings 45, and the front and back halves of the ski can be independently adjusted to the skier's preference. A further benefit of this arrangement is that the ski body continues to maintain a curved arc under the boot instead of becoming flat as with a conventional boot/binding/ski arrangement. With the resilient or hard elements as fulcrums, pins 17 are pulled down within the elastomers 30, allowing the central region of the ski body 12 to bend down as the tip and tail bend up, thus preserving the continuous arc under the boot that is vital to a pure carved turn. This dual flex pattern feature, coupled with the initial high spring rate "preload" feature previously described, creates a distinct triple flex pattern or three stage suspension design. Additionally, the support structure could include more than one such resilient or rigid assembly 46 located within the support structure 16 in the regions between the mounting pins 17 and the respective ends of the support structure such that the attached ski would exhibit three or more distinctive spring rates that become progressively greater as deflection increases. Together with the high spring rate initial 'preload' characteristics described herein, a ski attached to such a suspension system would exhibit four or more distinct stages of suspension travel as deflection commences from the unloaded or free camber state through maximum deflection, specifically an initial extremely high spring rate followed by a low spring rate and then zones of progressively higher spring rates. Moreover these characteristics can be individually optimized for the front and back of the ski body independently.

Figure 20A:
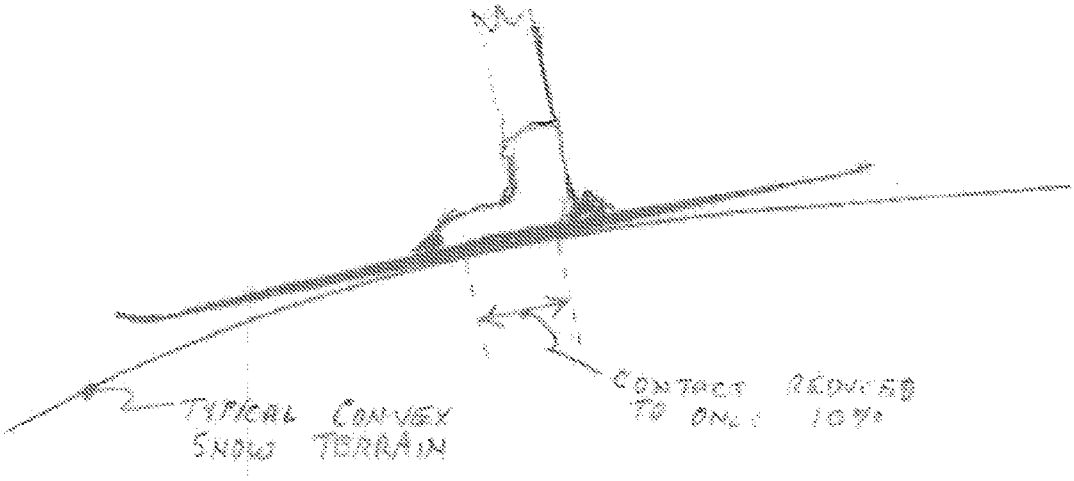
FIG. 20A is an illustration of a conventional ski on convex terrain.

All the aforementioned implementations and variations of the suspension system create highly desirable long-travel suspension characteristics. Conventional skis generally cannot conform to convex terrain and are essentially flat when unloaded, with virtually no pressure on the tip and tail. Pressure on the tip and tail does not become significant until the tip and tail are bent upward into an arc, as in a significant turn. Thus, if a conventional ski encounters even a minor convex surface, such as the crest of a bump or the steepening of terrain, the ski can lose up to 90% of it's longitudinal contact with the snow (FIG. 20A), causing complete loss of control.

Figure 20B:
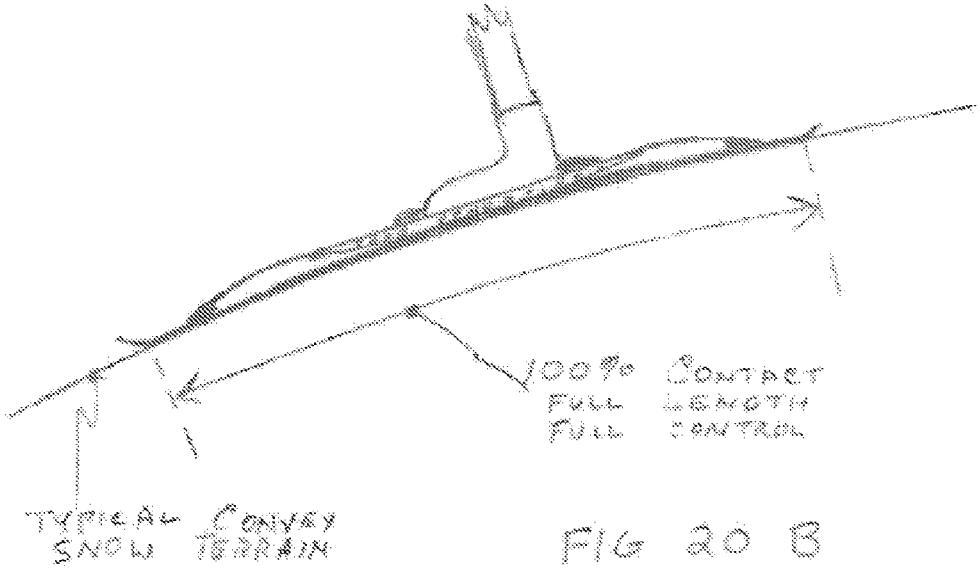
FIG. 20B is an illustration of an implementation of the invention on convex terrain.

The long-travel suspension characteristics of the above-described suspension systems maintain significant pressure on the tip and tail and specifically do so with the ski body bent into a severe downward camber arc of up to 2 inches or more. Referring to FIG. 20B, the ski runner with the suspension described above conforms to the convex shape of bumps and terrain variations, keeping the full length of the runner and edge in contact with the snow for complete control. Moreover, the tip and tail are controlled independently and will conform to terrain with concave to convex transitions. These long travel suspension characteristics also prevent loss of control when the skier is imbalanced by maintaining tip and tail pressure and contact in those instances where the tip and/or tail would previously leave the snow surface.

The novel geometry and mechanical design of this system creates significant pressure on the tip and tail in the first small increment of deflection (typically 0.10 to 0.40 inch) from the fully unloaded "extreme camber" configuration. Thus in the first small increment of deflection the suspension system rapidly loads up, exhibiting an extremely high maximum spring rate on the order of 100 pounds per inch or more. Thereafter, when subjected to further deflection the suspension system substantially maintains a relatively constant pressure, exhibiting a very low or diminishing spring rate over the full suspension travel and deflection of the ski body. In practical terms, the full longitudinal length of the ski body is always pressured and kept in contact with the snow through all normally encountered recreational ski maneuvers and terrain conditions.

Another novel characteristic of this arrangement helps stabilize an imbalanced skier. If the skier's weight is shifted to the rear, the support structure 16 correspondingly pitches downward in the rear and upward in the front. This elevated height at the front raises the pivoting end of the front spring 37A, creating a steeper angle between the spring 29 and the ski body 12. This in turn increases the vertical downward force applied by the spring to the ski body tip, which, together with the inherent long travel suspension, helps keep it in positive contact with the snow despite the backward stance of the skier thus maintaining skier control. Without these features, an imbalanced skier leaning back would cause the front of the ski to tip upward and lose contact with the snow, resulting in the skier losing control.

Figure 21:
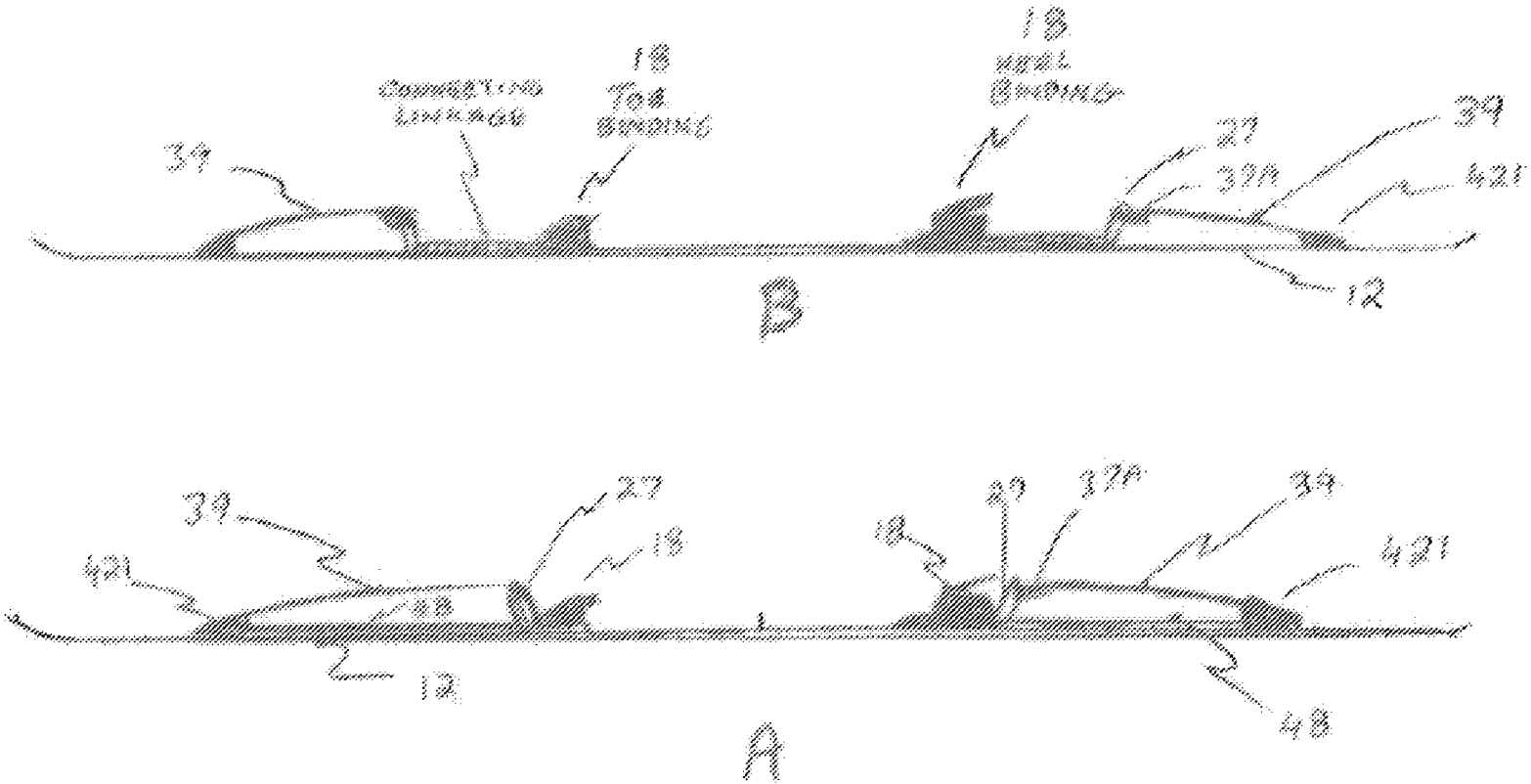
FIGS. 21A and 21B are side views of alternate implementations.
Figure 22:
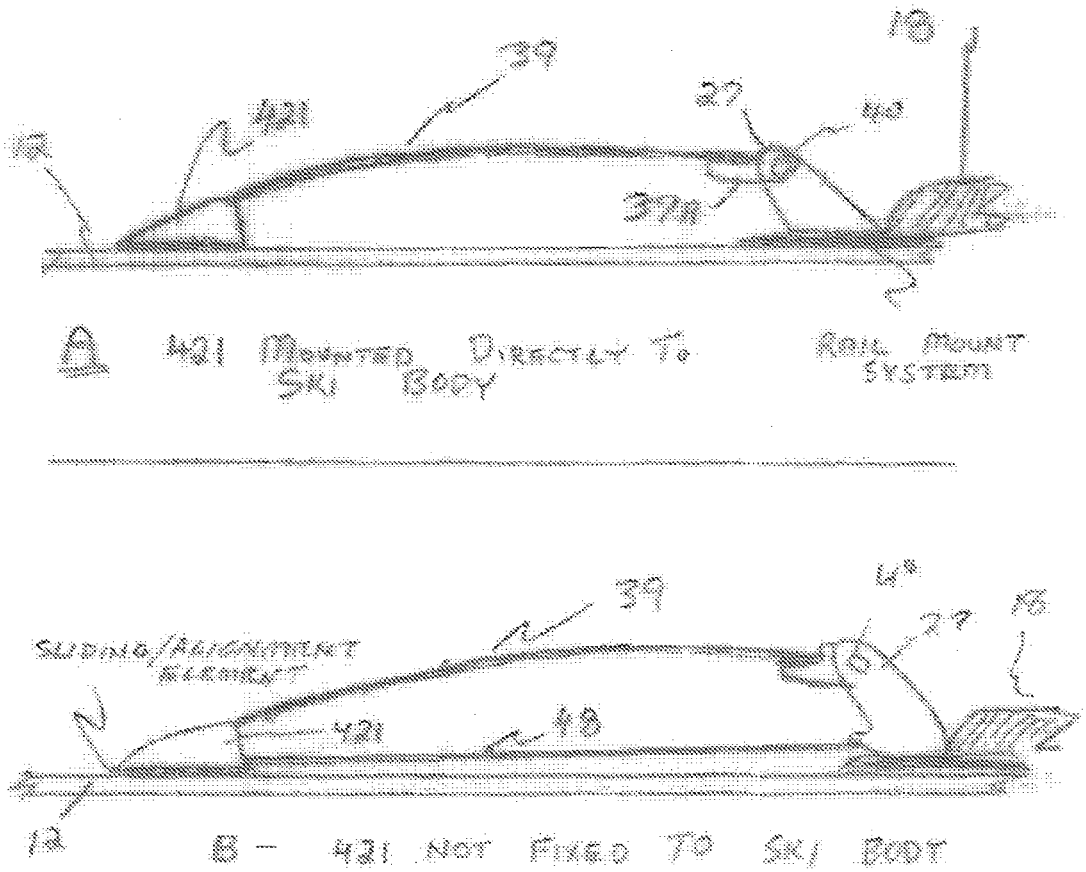
FIG. 22A is an enlarged side view of a portion of the ski shown in FIG. 21A.
FIG. 22B is an enlarged side view showing an alternative mounting for the bracket 421 shown in FIG. 22A.

Another alternate implementation is designed for use on skis incorporating bindings attached directly to the ski body by currently conventional means. This implementation utilizes the basic spring components of the previous implementations illustrated in FIGS. 11-13 & 19, however the support structure 16 and all related mounting components are eliminated. Referring to FIGS. 10, 11, 11A, 21 & 22, the spring mounting brackets 27 are now attached directly or indirectly to the toe piece and heel piece of the boot binding. For skis incorporating sliding systems or "rail" systems such as Tyrolia's RAILFLEX™ binding system, the brackets 27 can slide onto the existing rail device that is part of the ski body. The brackets would have means to affix them to the respective binding pieces or rail base so that the brackets would slide in unison with the binding pieces as the ski flexes. This attachment method would also retain the brackets on the ski body. The hole 40 in the leaf spring mounting bracket 27 is situated at a specific height above the upper surface of the ski body to create the proper geometry for the spring action, which results in the aforementioned preload and diminishing spring rate features. The spring mounting brackets 27 can be located directly next to the respective binding piece (FIG. 21A) or at a specific distance from each binding piece by utilizing a connecting linkage (FIG. 21B). In addition, the mounting brackets 27 can be configured to place the hole 40 over portions of the boot binding apparatus to achieve the geometry to support specific suspension system characteristics.

For those applications where the ski body 12 does not include the newer rail type systems, the mounting bracket 27 may be attached directly to the binding pieces or to the ski body 12 as shown in FIG. 21A. For example, such a mounting bracket 27 could include a plate that fits under the boot binding and is thus affixed by being sandwiched between the boot binding and the ski body. The plate could include a plurality of holes to allow the boot binding mounting screws to pass through and thus positively retain the bracket.

FIGS. 22A & B illustrate a leaf spring assembly and the related mounting hardware. One end of the leaf spring is fitted with a mounting boss 37 while the other end has means to be attached to mounting bracket 421. The bracket 421 is designed to hold the resilient component 39 at a specific angle relative to the top of the ski body 12, typically between 15 and 30 degrees. With this angle optimized, the resilient component provides the ski body with the characteristic downward preload force, the diminishing spring rate feature, and the pretension function that limits the extent of camber.

The mounting bracket 421 can be mounted to the ski body 12 with one or more screw(s), industrial adhesives, or it can be integrally incorporated into the ski body 12.

Alternately, the leaf spring assembly illustrated in FIG. 12A may be substituted for those shown in FIGS. 21A, B and 22 A, B wherein mounting bracket 21 replaces bracket 421.

Alternately, mounting bracket 21 can rest on the ski body, free to slide along the ski body longitudinally as the ski is deflected and this system can include a longitudinal retention track within bracket 21 that mates with an alignment structure 51 that can be affixed to or incorporated into the ski body to retain and maintain lateral alignment of the bracket 21 as it slides longitudinally. In the latter case, a non-elastic tension element 48 should generally be included between the bracket 21 and the respective binding piece or spring mounting bracket 27 in order to maintain the leaf spring in the compressive mode. The tension element 48 can be as simple as a stainless steel cable and include means for the length to be adjustable in order to adjust the degree of camber and/or the degree of compression of resilient component 39.

Figure 23:
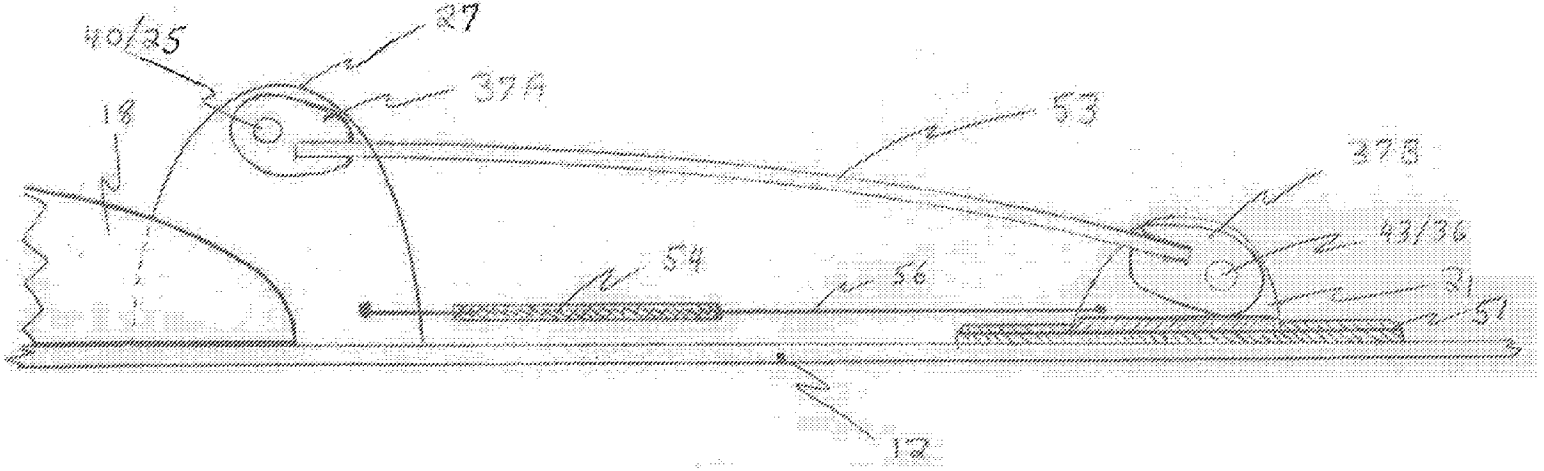
FIG. 23 is a side view of an alternate implementation with a tension spring.

An alternate implementation is illustrated in FIG. 23 wherein resilient component 39 is replaced by a substantially rigid link 53 and the tension element 48 is replaced by a tension spring 54. The tension spring 54 would preferably exhibit a very high spring tension and a low spring rate as installed herein. The track 51 should have means to limit the longitudinal range of movement of the bracket 21 so as to maintain a specific degree of camber. Such motion limiting means can be adjustable in order to vary the degree of camber. In this configuration, the tension spring creates a downward force on the ski body 12 by the rotational moment of the substantially rigid link 53 about pin 25.

Figure 24:
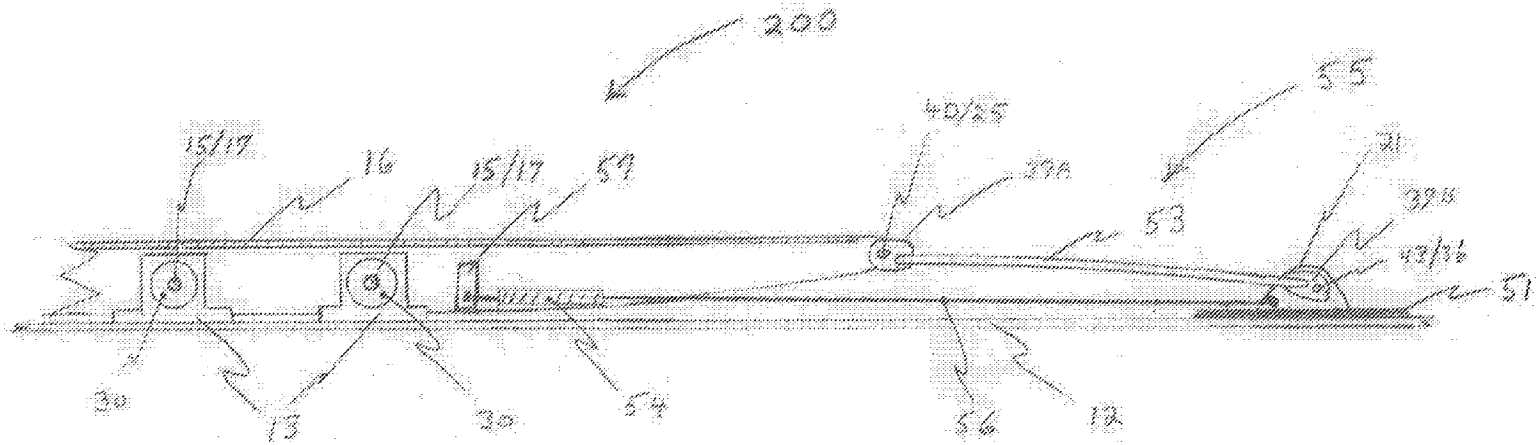
FIG. 24 is a side view of an alternate implementation with a tension spring and a support structure.

In addition, this implementation may be incorporated into the implementation illustrated in FIG. 11A. As illustrated in FIG. 24, the spring assembly 29" is replaced with the rigid link assembly 55 wherein resilient component 39 is replaced by a substantially rigid link 53. The mounting bracket 21 is free to slide along the ski body longitudinally as the ski is deflected and can include a longitudinal retention track that mates with an alignment structure 51 that can be affixed to or incorporated into the ski body to retain and maintain lateral alignment of the bracket 21 as it slides longitudinally. A tension spring 54 is located within the support structure 16 with one end attached to a bracket 57 that is attached to the support structure 16. The other end of the tension spring is connected by a cable or rigid link 56 to the sliding bracket 21. The tension spring 54 would preferably exhibit a very high spring tension and a low spring rate as installed herein. The track 51 should have means to limit the longitudinal range of movement of the bracket 21 so as to maintain a specific degree of camber. Such motion limiting means can be adjustable in order to vary the degree of camber. The tension spring 54 may be, for example, a coil spring, torsion spring, gas spring, elastomer, gas shock, or other type of spring. In addition, such tension springs may include damping elements and may also be a compression type combined with a conversion linkage to create the required tension characteristics. The tension springs may also be a single spring device either compression or tension, that, though appropriate linkage, provides the tension function of springs 54. In addition, the spring mounting bracket 57 can be adjustable attached to the support structure to allow both height and longitudinal movement, thus providing variations in suspension geometry and characteristics.

The relative distance and angles between the mounting bracket 421 or 21 and the axle hole 40 in bracket 27, as well as the height distance of the mounting hole 40 from the ski body 12 and the respective binding piece, determines the performance characteristics of the suspension system with regard to preload, camber, and spring rate. All of these parameters can be optimized and regulated by providing simple means to adjust and alter these geometric relationships.

Alternately, these implementations could comprise any of the other spring and bracket arrangements previously shown and described.

Accordingly, other implementations are within the scope of the following claims.

What is claimed is:

1. A suspension system for a ski comprising:

at least two compressible elements;

a support structure configured to attach one end of each of the compressible elements to the central half of the longitudinal running length of a ski body; and a mounting system that attaches said support structure to the ski body in a manner that substantially precludes yaw and roll movement between the support structure and the ski body, wherein:

the compressible elements are configured so that the opposite ends of the compressible elements contact the ski body at contact points on the front-most and rear-most fifth of the longitudinal running length of the ski body, and apply a downward force at the respective contact points such that the degree of free camber of the ski is increased relative to the natural free camber of the ski body without said suspension system attached;

at least two of the compressible elements are attached to the central half of the longitudinal running length of the ski body by a support structure that is attached to the central third of the longitudinal running length of the ski body; and the mounting system comprises elements configured to allow elastic movement between the support structure and the ski body in the vertical and longitudinal directions as well as around a pitch axis.

2. The suspension system of claim 1 further comprising a boot binding carried by the support structure.

3. The suspension system of claim 2 wherein the support structure is releasably attached to the ski body.

4. The suspension system of claim 2 comprising an additional compressible or rigid element in the support structure configured so that at a predetermined degree of deflection of the ski body to which it is attached, upon further deflection said ski body exhibits a spring rate greater than that exhibited immediately prior to said predetermined state of deflection.

5. The suspension system of claim 4 wherein said predetermined state of deflection is adjustable.

6. The suspension system of claim 5 wherein said adjustability can be applied independently to the forward longitudinal half and rearward longitudinal half of the ski body to which it is attached.

7. The suspension system of claim 5 further comprising a mechanism that changes the vertical position of said compressible or rigid elements with respect to the said support structure, thereby providing said adjustability.

8. The suspension system of claim 1 wherein the suspension system is configured to provide the ski body to which it is attached with a spring rate that diminishes as the ski body is flexed from a normal unloaded state or a predetermined state of deflection to a state of greater deflection.

9. A suspension system for a ski comprising:

at least two compressible elements; and a support structure configured to attach one end of each of the compressible elements to the central half of the longitudinal running length of a ski body, wherein:

the opposite ends of the compressible elements contact said ski body at contact points on the front most fifth and rear most fifth of the longitudinal running length of the ski body, and each applies a downward force at the respective contact point such that at a predetermined degree of deflection, the ski body will exhibit a spring rate at least 25% less than the maximum spring rate exhibited by said ski prior to said predetermined degree of deflection; and the ski body, during the first 0.5 inch of deflection, exhibits a maximum spring rate that is at least 150% of the average spring rate exhibited during the following 0.75 inch of deflection.

10. The suspension system of claim 9 wherein said support structure comprises elements of a boot binding apparatus that is attached to the ski body.

11. The suspension system of claim 9 wherein said support structure comprises elements of an integrated boot binding attachment apparatus of the ski body.

12. The suspension system of claim 9 wherein at least two of the compressible elements are attached to the central half of the longitudinal running length of the ski body by a support structure that is attached to the central third of the longitudinal running length of the ski body.

13. The suspension system of claim 9 wherein the at least two compressible elements comprise spring(s) selected from the group consisting of bow springs, leaf springs, coil springs, torsion springs, torsion bars, gas springs, gas shocks, and elastomers.

14. The suspension system of claim 9 configured so that in order to deflect the ski body 0.25 inch, it is necessary to apply a force of 15 pounds or greater.

15. The suspension system of claim 14 configured so that in order to deflect the ski body 0.25 inch, it is necessary to apply a force of 20 pounds or greater.

16. The suspension system of claim 9 configured so that in order to deflect the ski body ⅛ inch, it is necessary to apply a force of 12 pounds or greater.

17. The suspension system of claim 9 wherein the suspension system is configured to contribute at least 20% to the resistive force that must be overcome in order to deflect the ski body from zero deflection to 0.25 inch deflection, the remaining resistive force being contributed by the ski body.

18. The suspension system of claim 17 wherein the suspension system is configured to contribute at least 50% to the resistive force that must be overcome in order to deflect the ski body from zero deflection to 0.25 inch deflection, the remaining resistive force being contributed by the ski body.

19. The suspension system of claim 17 wherein the suspension system is configured to contribute 100% to the resistive force that must be overcome in order to deflect the ski body from zero deflection to 0.25 inch deflection.

20. The suspension system of claim 9 wherein the suspension system is configured so that a downward force greater than 15 pounds is required to be applied at the longitudinal center of the ski body in order to deflect the center of the ski body 0.3 inch from the shape of the ski body when it is unpressured while placed on a flat horizontal surface.

21. The suspension system of claim 20 wherein the suspension system is configured so that a downward force greater than 20 pounds is required to be applied at the longitudinal center of the ski body in order to flatten the ski body into a longitudinally collinear shape against a hard flat surface.

22. A suspension system for a ski comprising:

at least two compressible elements; and a support structure configured to attach one end of each of the compressible elements to the central half of the longitudinal running length of a ski body, wherein:

the compressible elements are configured so that the opposite ends of the compressible elements contact the ski body at contact points on the front-most and rear-most fifth of the longitudinal running length of the ski body, and apply a downward force at the respective contact points such that the degree of free camber of the ski body is increased relative to the natural free camber of the ski body without said suspension system attached;

at least two of the compressible elements are attached to the central half of the longitudinal running length of the ski body by a support structure that is attached to the central third of the longitudinal running length of the ski body; and the suspension system is configured so that a rearward movement of a skier's center of gravity increases the downward pressure applied by the forward compressible element of the suspension system to the forward fifth of the ski body, and a forward movement of a skier's center of gravity increases the downward pressure applied by the rear compressible element of the suspension system to the rear fifth of the ski body.

* * * * *